US008982170B2

(12) United States Patent
Furukawa et al.

(10) Patent No.: US 8,982,170 B2
(45) Date of Patent: Mar. 17, 2015

(54) INFORMATION PROCESSING APPARATUS, INFORMATION PROCESSING METHOD, INFORMATION PROCESSING SYSTEM, COMPUTER PROGRAM AND COMPUTER-READABLE MEDIUM

(71) Applicants: Takahiro Furukawa, Shizuoka (JP); Tetsuhiko Shohoji, Tokyo (JP)

(72) Inventors: Takahiro Furukawa, Shizuoka (JP); Tetsuhiko Shohoji, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/356,425

(22) PCT Filed: Nov. 20, 2012

(86) PCT No.: PCT/JP2012/080523

§ 371 (c)(1),
(2) Date: May 6, 2014

(87) PCT Pub. No.: WO2013/077453

PCT Pub. Date: May 30, 2013

(65) Prior Publication Data

US 2014/0313274 A1 Oct. 23, 2014

(30) Foreign Application Priority Data

Nov. 25, 2011 (JP) ..... 2011-258140
Sep. 7, 2012 (JP) ..... 2012-197727

(51) Int. Cl.
*B41J 2/435* (2006.01)
*B41J 2/44* (2006.01)
*B41J 2/475* (2006.01)

(52) U.S. Cl.
CPC ..... *B41J 2/442* (2013.01); *B41J 2/4753* (2013.01)
USPC ..... 347/224

(58) Field of Classification Search
USPC ..... 347/224, 225, 237, 247, 110
See application file for complete search history.

(56) References Cited

U.S. PATENT DOCUMENTS 7,463,395 B2 * 12/2008 Utagawa et al. ..... 359/212.1
7,972,990 B2 7/2011 Iino et al.

(Continued)

FOREIGN PATENT DOCUMENTS

EP 1834795 A1 9/2007
EP 1897695 A2 3/2008

(Continued)

OTHER PUBLICATIONS

International Search Report Issued Dec. 25, 2012 in PCT/JP2012/080523 filed on Nov. 20, 2012.

*Primary Examiner* — Hai C Pham
(74) *Attorney, Agent, or Firm* — Cooper & Dunham LLP

(57) ABSTRACT

An information processing apparatus that generates a drawing command for drawing visual information by irradiating laser light on a recording medium includes a line information obtaining unit that obtains line information of a line including a starting point of the line; a line segment dividing unit that obtains a drawing distance to be drawn over a predetermined time period that must elapse before an impact of residual heat from drawing an adjacent line can be disregarded and divides at least a portion of the line from the starting point to the drawing distance into a line segment having a predetermined length; and a control factor adjusting unit that adjusts a control value of a laser control factor that affects a density of the line segment such that the control value for the line segment that is affected by a greater amount of residual heat is adjusted to a greater extent.

11 Claims, 29 Drawing Sheets

(56) References Cited

U.S. PATENT DOCUMENTS

| | | | | |
|---|---|---|---|---|
| 8,284,226 | B2 * | 10/2012 | Hasegawa et al. | 347/224 |
| 8,665,496 | B2 | 3/2014 | Hasegawa et al. | |
| 2011/0090299 | A1 | 4/2011 | Asai et al. | |
| 2012/0162340 | A1 | 6/2012 | Furukawa et al. | |
| 2012/0212564 | A1 | 8/2012 | Yamamoto et al. | |

FOREIGN PATENT DOCUMENTS

| | | | |
|---|---|---|---|
| EP | 2311642 | A1 | 4/2011 |
| EP | 2320353 | A2 | 5/2011 |
| JP | 2002-178173 | | 6/2002 |
| JP | 2008-062506 | | 3/2008 |
| JP | 2010-156950 | | 7/2010 |
| JP | 2011-000612 | | 1/2011 |
| JP | 2011-056910 | | 3/2011 |
| JP | 2011-104994 | | 6/2011 |
| JP | 2011-116116 | | 6/2011 |
| JP | 2012-056134 | | 3/2012 |
| WO | WO 2011/049147 | A1 | 4/2011 |
| WO | WO 2011/049148 | A1 | 4/2011 |

* cited by examiner

FIG.5B

| In | W | Sp | | Ep | |
|---|---|---|---|---|---|
| [0] | 1 | 20 | 70 | 70 | 70 |
| [1] | 1 | 70 | 70 | 70 | 20 |
| [2] | 1 | 70 | 20 | 20 | 20 |
| [3] | 1 | 20 | 20 | 20 | 70 |
| [4] | 0 | 20 | 70 | 45 | 60 |
| [5] | 1 | 45 | 60 | 60 | 60 |
| [6] | 0 | 60 | 60 | 52 | 57 |
| [7] | 1 | 52 | 57 | 52 | 30 |
| [8] | 0 | 52 | 30 | 100 | 0 |
| | | | . . | | |

FIG.6A
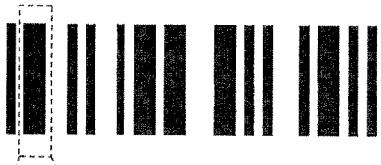
FIG.6B
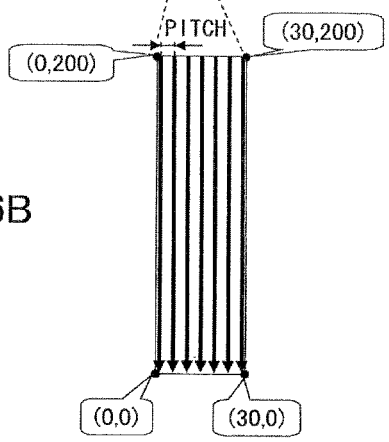
FIG.6C
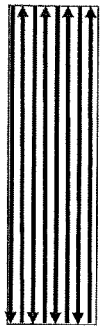
FIG.6D
| In | W | Sp | Ep |
|---|---|---|---|
| [0] | 1 | 0 200 | 0 0 |
| [1] | 1 | 2 0 | 2 200 |
| [2] | 1 | 4 200 | 4 0 |
| : | : | : | : |

| | P(1) | P(2) | P(3) |
|---|---|---|---|
| T1 | TIME t1 | TIME t2 | TIME t3 |
| T2 | TIME t4 | TIME t5 | TIME t6 |
| T3 | TIME t7 | TIME t8 | TIME t9 |

FIG.16

| BYTE | INFORMATION |
|---|---|
| 0 – 1 | STARTING POINT X COORDINATE |
| 2 – 3 | STARTING POINT Y COORDINATE |
| 4 – 5 | END POINT X COORDINATE |
| 6 – 7 | END POINT Y COORDINATE |
| 8 – 9 | LASER OUTPUT |
| 10 – 11 | DRAWING SPEED |

lo : STROKE LENGTH
lu : LINE SEGMENT LENGTH
n : NUMBER OF ADJUSTMENT LEVELS

INFORMATION PROCESSING APPARATUS, INFORMATION PROCESSING METHOD, INFORMATION PROCESSING SYSTEM, COMPUTER PROGRAM AND COMPUTER-READABLE MEDIUM

TECHNICAL FIELD

The present invention relates generally to an information processing apparatus, an information processing method, an information processing system, and a computer program for executing the information processing method. The present invention particularly relates to an information processing apparatus that generates a drawing command for drawing an object on a recording medium by irradiating laser light.

BACKGROUND ART

Technology for writing characters and symbols on a sheet medium such as paper using laser are practically applied in various fields. For example, such technology may be used to facilitate drawing characters and other objects on labels of containers used at factories and other sites. Also, practical applications are developing for rewritable thermal paper (referred to as "rewritable paper" hereinafter) that can have objects drawn and erased multiple times. For example, in the context of applying this technology to containers used in product distribution, since the destination of a container is net necessarily the same each time it is dispatched, the above technology may be used to erase characters drawn on a label so that new characters can be drawn on the same label. In this way, the need to replace the label may be reduced.

It is noted that the color of rewritable paper may be erased at a certain temperature, and the thermal paper may develop color when en even higher temperature is applied thereon. However, when excessive heat is applied, the rewritable paper may be prone to degradation. That is, the properties of the rewritable paper may be altered, the lifecycle of the rewritable paper may be reduced, and/or the rewritable paper may lose its ability to completely erase its color, for example. Excessive heating may occur when heat is further applied to a region that is already at a relatively high temperature. In the case of drawing objects on a label, a region where characters and symbols cross and/or a region in which adjacent parallel lines are drawn to fill in the region may be prone to degradation due to excessive heating.

In consideration of the above, control techniques are known for controlling a laser irradiating apparatus to refrain from applying excessive heat on rewritable paper (e.g., see Japanese Laid-Open Patent Publication Nos. 2008-62506 and 2011-116116).

Japanese Laid-Open Patent Publication No. 2008-62506 discloses a control method for controlling the time between the start of drawing a first line and the end of drawing a second line or the overlapping width of the first line and the second line upon drawing parallel lines that are adjacent to each other.

Japanese Laid-Open Patent Publication No. 2011-116116 discloses dividing an image plotting target into plural rows (line segments) and controlling the laser output and/or the drawing speed for each row. In this way, excessive heating may be prevented, coloration characteristics of the rewritable paper may be improved, and the image quality of a colored-in region may be improved.

However, merely dividing an image plotting target into plural rows as described above may not adequately improve the image quality of the colored-in region.

FIG. 1 is a diagram illustrating a problem that may be encountered when a stroke to be drawn is relatively short. The two arrows pointing upwards and downwards shown at the left side of FIG. 1 represent strokes (lines) of an object to be drawn. A laser irradiating apparatus draws the left stroke (arrow pointing downward) first and then the right stroke (arrow pointing upward). Thus, when drawing the right stroke, residual heat may remain from drawing the left stroke.

The arrows at the right side of FIG. 1 illustrate an exemplary manner of controlling the scanning speed for drawing the right stroke. In the related art, one stroke is divided into a given number of line segments and the scanning speed is adjusted for each line segment. In the illustrated example of FIG. 1, the right stroke is divided into four line segments. It is noted that the scanning speed is not controlled segment-by-segment for the left stroke. The left stroke is broken into three segments in FIG. 1 to illustrate the differences in residual heat affecting the line segments; however, the scanning speed is maintained constant when drawing the left stroke.

As is shown in FIG. 1, the amount of residual heat around the starting point of the left stroke is relatively small, whereas the amount of residual heat near the end point of the stroke is relatively large. Thus, when drawing the right stroke that is divided into four line segments, the lower line segment is arranged to be drawn at a faster scanning speed than the higher line segment. Assuming the scanning speeds for drawing the four line segments of the right stroke are denoted as drawing speeds S(1)-S(4) as is shown in FIG. 1, where S(4) represents the normal drawing speed, their relationship may be represented as follows:

$$S(1)>S(2)>S(3)>S(4).$$

In FIG. 1, the right stroke is divided into four line segments even though the stroke is relatively short. Thus, the line segment including the end point of the right stroke is drawn at the normal drawing speed S(4) even though heat may still remain around the starting point of the left stroke. In this case, the temperature of the rewritable paper at the upper portion of the right stroke may rise to an undesirably high level.

FIG. 2 is a diagram illustrating a problem that may be encountered when a stroke to be drawn is relatively long. In FIG. 2, even though the strokes are longer than those of FIG. 1, the right stroke is still divided into four line segments. It is noted that the scanning speed for drawing the left stroke is not controlled segment-by-segment as in the example of FIG. 1.

In FIG. 2, since the strokes are relatively long, residual heat does not remain around the starting point of the left stroke, the amount of residual heat at the middle portion of the left stroke is relatively small, and the amount of residual heat around the end point of the left stroke is relatively large. However, the line segments of the right stroke are drawn at the drawing speeds S(1)-S(4) in a manner similar to FIG. 1, where the lower line segment is drawn at a higher speed than the higher line segment. In this case, the end portion of the line segment drawn at the fastest drawing speed S(1) is located near the middle portion of the left stroke where the amount of residual heat is smaller, and as a result, the temperature of the rewritable paper at this portion may not rise to a sufficient level. It is noted that the same problem occurs at the end portion of the line segment drawn at drawing speed S(2) that is located near the middle portion of the left stroke where the amount of residual heat is small and the end portion of the line segment drawn at speed S(3) that is located near the starting point of the left stroke where there is no residual heat.

As can be appreciated, the drawing time for drawing an adjacent stroke and the impact of residual heat from drawing the adjacent stroke differ depending on the length of the stroke. However, the related art does not contemplate a method for determining the appropriate laser output level and drawing speed based on such factors.

DISCLOSURE OF THE INVENTION

Problems to be Solved by the Invention

It is a general object of at least one embodiment of the present invention to provide an information processing apparatus that substantially obviates one or more problems caused by the limitations and disadvantages of the related art.

One object of at least one embodiment of the present invention is to provide an information processing apparatus that is capable of controlling the impact of residual heat on the coloration quality of a recording medium to thereby improve the coloration quality of a stroke that is drawn on the recording medium.

Means for Solving the Problems

In one embodiment of the present invention, an information processing apparatus that generates a drawing command for prompting a drawing apparatus to draw visual information by irradiating laser light on a recording medium is provided. The information processing apparatus includes a line information obtaining unit that obtains line information of a line including a starting point of the line; a line it segment dividing unit that obtains a drawing distance to be drawn over a predetermined time period that must elapse before an impact of residual heat from drawing an adjacent line can be disregarded and divides at least a portion of the line from the starting point to the drawing distance into a line segment having a predetermined length, the drawing distance being determined based on the predetermined time period and a drawing speed for drawing the line; and a control factor adjusting unit that adjusts a control value of a laser control factor that affects a density of the line segment on the recording medium, the control value being adjusted with respect to a normal control value such that the control value for the line segment that is affected by a greater amount of residual heat is adjusted to a greater extent.

Effects of the Present Invention

According to an aspect of the present invention, an information processing apparatus may be provided that is capable of controlling the impact of residual heat on the coloration quality of a recording medium to thereby improve the coloration quality of a stroke that is drawn on the recording medium.

BRIEF DESCRIPTION OF THE DRAWINGS

FIGS. 5A-5B illustrate examples of a drawing object and a control command used by a writing control apparatus to draw the drawing object;

FIGS. 6A-6D illustrate an exemplary manner of generating a control command in the case of drawing a barcode on rewritable paper;

FIG. 16 is a table showing an exemplary control command that designates control values for drawing a line segment;

DESCRIPTION OF THE REFERENCE NUMERALS

11: CONVEYOR
12: LASER WRITING SYSTEM
13: CONTAINER
14: REWRITABLE PAPER
20: WRITING CONTROL APPARATUS
21: LASER OSCILLATOR
22: SPOT DIAMETER ADJUSTING LENS
23: DIRECTION CONTROL MOTOR
24: DIRECTION CONTROL MIRROR

25: FOCAL LENGTH ADJUSTING LENS
30: LASER IRRADIATING APPARATUS
31: LINE SEGMENT DIVIDING UNIT
32: LASER OUTPUT ADJUSTING UNIT
33: DRAWING SPEED ADJUSTING UNIT

MODE FOR CARRYING OUT THE INVENTION

In the following, embodiments of the present invention are described with reference to the accompanying drawings.

[Control Command]

Figure 3:
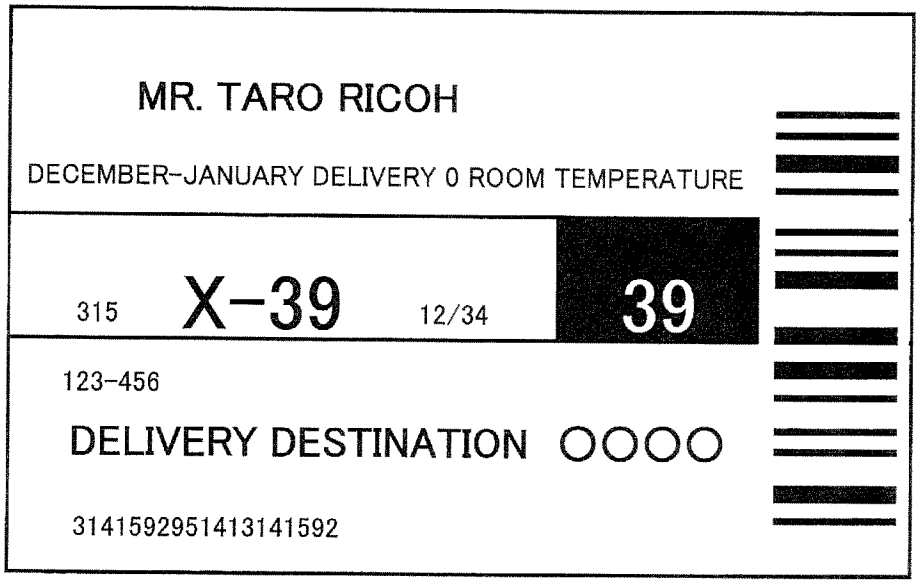
FIG. 3 shows a label having characters and objects drawn thereon as an example of rewritable paper used in an embodiment of the present invention.

FIG. 3 shows a label having characters and other objects drawn thereon as an example of rewritable paper used in an embodiment of the present invention. The label shown in FIG. 3 has plural objects such as numbers, characters, figures, and a barcode drawn thereon. When drawing characters, laser is condensed by a lens into a focused beam so that even intricate characters may be drawn. When drawing characters and other objects using laser, the laser irradiating position is controlled so that strokes (lines) of a character are drawn by the laser beam.

Figure 4A:
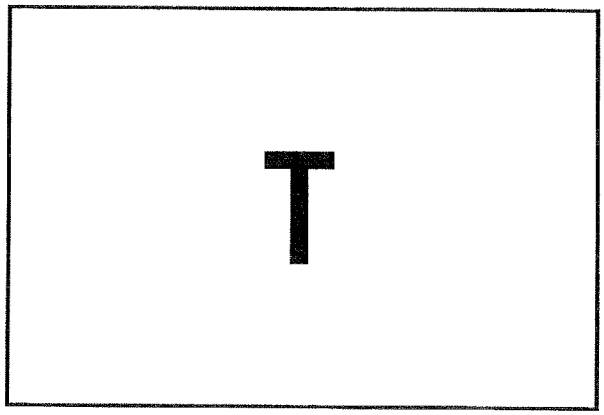
FIGS. 4A and 4B illustrate an example in which the letter T is drawn on rewritable paper.
Figure 4B:
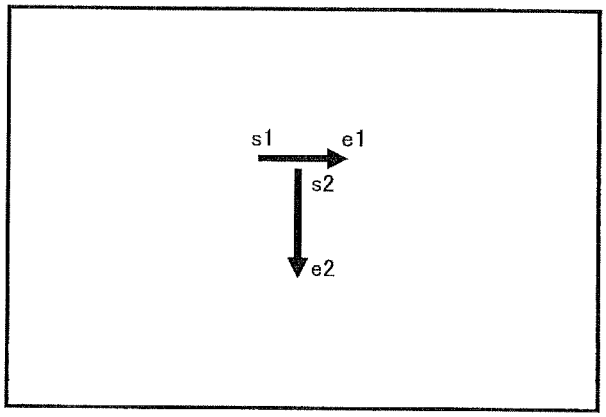

FIGS. 4A and 4B illustrate an example in which the letter T is drawn on rewritable paper. FIG. 4A shows an exemplary printout of the letter T output by a printing apparatus. The letter T is made up of two strokes, one lateral line and one vertical line. In the case of drawing this letter T using laser, laser irradiation is controlled to draw the above two strokes.

FIG. 4B shows exemplary pairs of starting points and end points, (s1, e1) and (s2, e2), of the two strokes making up the letter T. A writing control apparatus for controlling the laser irradiating position may move the laser irradiating position to the starting point s1 without irradiating any laser by adjusting the position of the laser beam using a galvano mirror, for example. Then, the writing control apparatus may start laser irradiation (may simply be referred to as "laser ON" hereinafter) and move the beam from the starting point s1 to the end point e1.

Then, the writing control apparatus may stop the laser irradiation (may simply be referred to as "laser OFF" hereinafter) and move the laser irradiating position to the starting point s2 without irradiating any laser. Then, the writing control apparatus may start laser irradiation and move the laser beam from the starting point s2 to the end point e2. In this way, the two strokes making up the letter T may be drawn on the rewritable paper.

When drawing characters and other objects on rewritable paper as described above, the writing control apparatus may control laser irradiating operations of a drawing apparatus such as a laser irradiating apparatus using a control command (drawing command) directing "laser ON from starting point to end point and move laser beam," for example.

In the present embodiment, one stroke refers to a line drawn from laser ON to laser OFF. It is noted that although a stroke is divided into plural line segments and the stroke is drawn segment-by-segment in the present embodiment, the laser is ON the entire time the line segments of the stroke are drawn so that the stroke is still regarded as one line. However, in the present embodiment, a control command and vector data may be generated for each line segment. In one embodiment, laser ON and laser OFF may be repeated for each line segment, but in this case, the line segments of the stroke will be regarded as plural strokes.

Figure 5A:
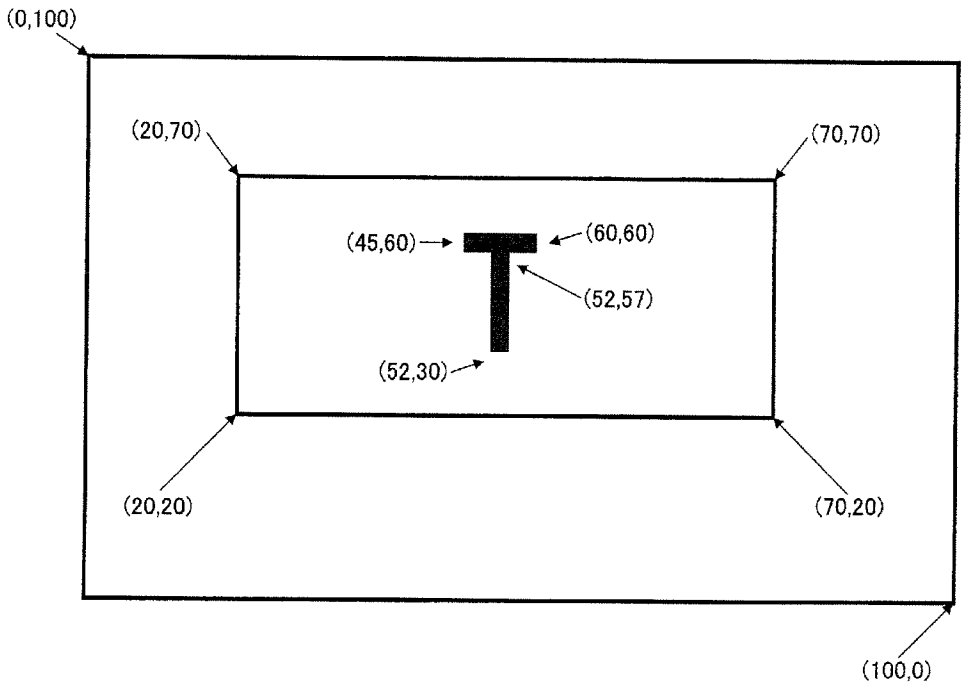

FIG. 5A shows an exemplary drawing object including a character and a figure. FIG. 5B shows an exemplary control command used by the writing control apparatus. It is noted that the references ln, N, Sp, and Ep in the control command shown in FIG. 5B represent the following:

ln: line number (stroke number)
N: laser ON/OFF ("1" denotes ON and "0" denotes OFF)
Sp: starting point coordinates
Ep: end point coordinates It is noted that the coordinates are represented as (X, Y) where K designates a position in the horizontal direction and Y designates a position in the vertical direction. The coordinate value of X increases as the position moves rightward. The coordinate value of Y increases as the position moves upward. It is noted that the above manner of defining a coordinate point is merely an illustrative example and other methods may be used as well.

In drawing an object such as a character or a figure (also referred to as "drawing object" hereinafter) on rewritable paper, a control command for controlling the laser beam is generated based on the drawing object. It is noted that laser irradiation control according to an embodiment of the present invention may contemplate additional processes such as rotating a character from its original position, removing overlapping portions between lines, and setting up other items of information. In this regard, drawing object data that is to be converted into a beam control command is preferably in vector data format.

FIGS. 6A-6D illustrate an exemplary manner of generating a control command in the case of drawing a barcode on rewritable paper. It is noted that although the illustrated example relates to generating a control command in the case of drawing a one-dimensional barcode, a control command for drawing a two-dimensional barcode may be generated in a similar manner. Also, the illustrated manner of generating the control command may be used in the case of coloring in a certain region such a figure. In the example described below, it is assumed that the writing control apparatus generates the vector data and the control command.

FIG. 6A shows an exemplary barcode that may be input to the writing control apparatus by a user. It is noted that barcodes may conform to a number of standards such as the JAN (Japanese Article Number), EAN (European Article Number), and UPC (Universal Product Code). Barcodes conforming to such standards may represent a number consisting of several digits based on the widths and spacings of parallel lines (bars) that are arranged in a certain pattern. The standards define rules for converting the widths and spacings of the bars into numbers 0-9. A computer may convert a digit sequence (e.g., 12 digits maximum) into a barcode and print out the barcode, and a scanner may read the barcode and convert the barcode back to the original digit sequence.

In the case of drawing a barcode such as that shown in FIG. 6A, a user may input the digit sequence represented by the barcode or the position information of the bars making up the barcode. It is noted that in the case where the digit sequence is input, the writing control apparatus calculates the position information of the bars making up the barcode based on the conversion rules of the corresponding barcode standard. In this way, the positions of the bars of the barcode shown in FIG. 6A may be determined. For example, with regard to the second bar from the left shown in FIG. 6A, the position information of the upper left corner of the bar is (0, 200), and the position information of the lower right corner of the bar is (30, 0). It is noted that the above position information is merely one illustrative example, and the position information may vary depending on the manner in which coordinates are defined.

Laser light may be arranged into a beam when irradiated on rewritable paper. To prompt a bar drawn on the rewritable paper to turn black (i.e., to increase the density), the drawing apparatus is controlled to scan a region of the rewritable paper where the bar is to be drawn so that the region may be colored. For example, as is shown in FIG. 6B, the writing control apparatus may generate vector data based on the position information of the bar. That is, vector data may be generated by extracting a vertical line extending from one side to the other side. It is noted that the vectors are spaced apart by a predetermined distance (pitch). The pitch (horizontal distance between the vectors) is adjustable and may be determined beforehand based on factors such as the spot light diameter, the laser output, and the coloration quality of the rewritable paper.

In some embodiments, horizontal vector data may be generated in addition to the vertical vector data when drawing the barcode as described above. However, a large amount of vector data may be generated in such a case. Thus, in the present example, only the vertical vector data of the bars are generated.

FIG. 6B shows an example of vector data including vectors in the same direction. When a control command is generated from such vector data, the idle running distance (i.e., moving distance along irradiating position while laser is not irradiated) may be relatively long and it may take a relatively long time to draw the barcode. Accordingly, in order to reduce the drawing time, a control command is preferably arranged to have a laser irradiated during both forward scanning and backward scanning operations. FIG. 6C shows an example of vector data including vectors having directions alternating between a forward direction and a backward direction. By generating a control command from such vector data, the drawing time for drawing the barcode may be reduced.

However, in this case, residual heat from drawing a previous stroke may influence the coloration (density) of the next stroke. Accordingly, the writing control apparatus may divide the stroke into plural line segments and adjust the drawing speed and/or the laser output for each of the line segments.

FIG. 6D shows an exemplary control command for drawing plural strokes. In FIG. 6D, ln represents the stroke number, F represents the laser ON/OFF status, Sp represents the starting point coordinates, and Ep represents the end point coordinates. In the illustrated example, the pitch is set equal to "2". Thus, the coordinates of the starting points Sp and the end points Ep of the first three strokes of the bar shown in FIG. 60 may be as follows:

0: (0, 200)→(0, 0)
1: (2, 0)→(2, 200)
2: (4, 200)→(4, 0)

In this way, a control command may be generated for drawing adjacent strokes that are shifted from each other in the horizontal direction by the predetermined pitch and are arranged to be drawn in forward and backward directions. Also, in the present embodiment, the length of the stroke may be determined based on the control command. It is noted that with respect to stroke 0 (ln=0) and stroke 1 (ln=1), stroke 0 may be regarded as the forward stroke and stroke 1 may be regarded as the backward stroke. With respect to stroke 1 (ln=1) and stroke 2 (ln=2), stroke 1 may be regarded as the forward stroke and stroke 2 may be regarded as the backward stroke. That is any stroke other than the first stroke (ln=0) may be regarded as the backward stroke in relation to an adjacent stroke.

The writing control apparatus may generate a control command to draw plural strokes for coloring in an enclosed region based on positional information of the enclosed region. It is noted that although the strokes are arranged to be substantially parallel to each other, they do not necessarily have to be completely parallel. Also, in some embodiments vector data such as that shown in FIG. 6C and/or a control command such as that shown in FIG. 6D may be generated beforehand. In such a case, the writing control apparatus may only need to divide the vectors of the vector data into plural line segments and adjust the drawing speed and the laser output for each line segment. In such an embodiment, the processing load of the writing control apparatus may be reduced.

[Drawing Speed Control]

Figure 7A:
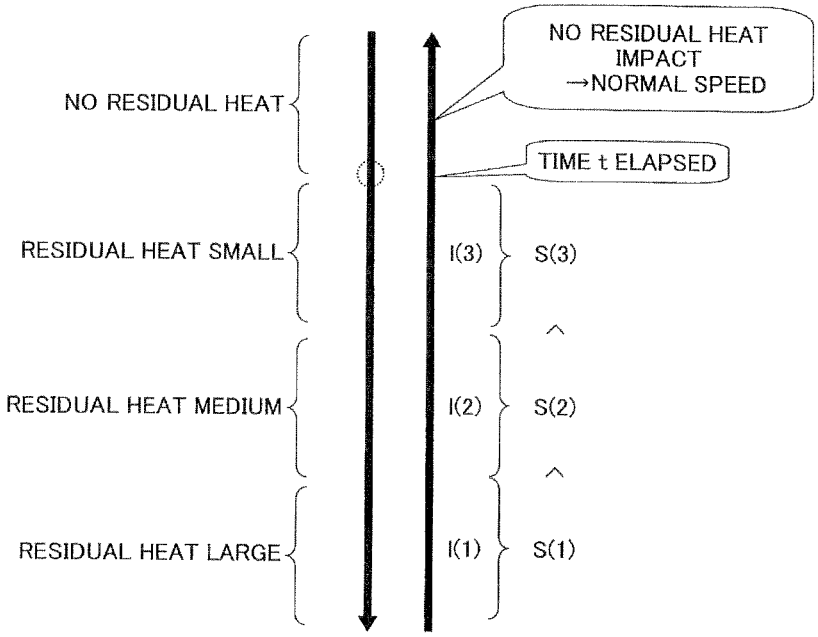
FIGS. 7A and 7B are diagrams showing exemplary ways of controlling a drawing speed based on a control command generated by a writing control apparatus according to an embodiment of the present invention.

FIGS. 7A and 78 are diagrams showing exemplary ways of controlling a drawing speed based on a control command generated by a writing control apparatus according to an embodiment of the present invention.

FIG. 7A shows an exemplary manner in which the drawing speed is controlled by a control command when a relatively long stroke is to be drawn.

In the present embodiment, the writing control apparatus determines a time t that must elapse from the time a forward stroke is drawn before residual heat may be deemed to have disappeared. By determining the time t beforehand, portions of a backward stroke that are affected by residual heat from drawing the forward stroke may be determined. In drawing the backward stroke, the point at which time t elapses (see circled portion in FIG. 7A) may be determined and the impact of residual heat from drawing the forward stroke may be disregarded after this point. That is, the drawing speed does not need to be controlled when drawing the portion of the backward stroke that will not be affected by the residual heat from drawing the forward stroke.

In the present embodiment, the portion of the backward stroke that is drawn before time t elapses may be divided into line segments and the drawing speed may be controlled for these line segments, In FIG. 7A, the portion of the backward stroke subject to such speed control is divided into three line segments, l(1)-l(3). Since the impact of residual heat from drawing the forward stroke is greater when drawing the portion of the backward stroke that is closer to the starting point, the drawing speed is adjusted such that a lower line segment of the backward stroke is drawn at a higher speed than a higher line segment.

Provided that first through x drawing speeds S(1)-S(x) are used to draw a stroke, and the relationship between the drawing speeds is defined as S(1)>S(2)>S(3)>S(4) . . . >S(x), in the present embodiment, the slowest drawing speed S(x) corresponds to the normal drawing speed.

In FIG. 7A, the writing control apparatus adjusts the drawing speed for drawing line segment l(1) to S(1), the drawing speed for drawing line segment l(2) to S(2), and the drawing speed for drawing line segment l(3) to S(3).

As can be appreciated, in the present embodiment, an appropriate drawing speed for drawing a line segment may be determined based on the amount of residual heat affecting the line segment. In this way, the temperature of a portion of the rewritable paper on which the backward stroke is to be drawn may be raised to a desirable level.

Figure 7B:
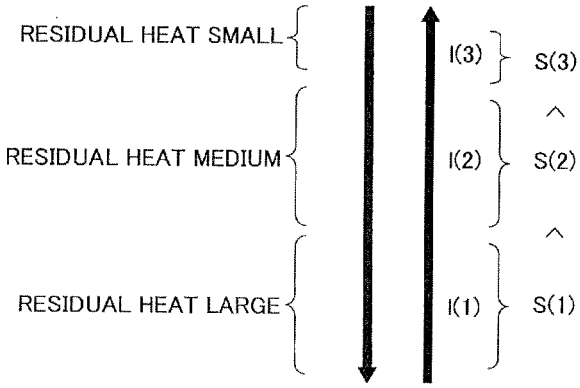

FIG. 7B shows an exemplary manner in which the drawing speed is controlled by a control command when a relatively short stroke is to be drawn. In the case where the backward stroke is relatively short, the entire length of the backward stroke may be affected by the residual heat from drawing the forward stroke upon drawing the backward stroke. As is described above, the impact of the residual heat is greater when drawing a portion of the backward stroke that is closer to the starting point. Accordingly, the backward stroke is divided into a number of line segments to adjust the drawing speed for drawing each of the line segments. It is noted that in the present embodiment, the length of a line segment is fixed regardless of the length of the stroke. Thus, the number of line segments into which a backward stroke is divided may vary depending on the length of the backward stroke. Also, the line segment including the end point of the backward stroke may be shorter than the rest of the line segments.

In FIG. 7B, the writing control apparatus divides the backward stroke into three line segments, l(1)-l(3), and adjusts the drawing speed for drawing line segment l(1) to S(1), the drawing speed for drawing line segment l(2) to S(2), and the drawing speed for drawing line segment l(3) to S(3). In this way, the portion of the backward stroke that is affected by a small amount of residual heat from drawing the forward stroke may be drawn at the drawing speed S(3), which is faster than the normal drawing speed, so that the rewritable paper may be prevented from overheating.

According to the present embodiment, the writing control apparatus has the time t determined beforehand, divides the portion of the backward stroke that is drawn before time elapses into plural line segments with a predetermined length, and controls the drawing speed for drawing the line segments. In this way, the impact of residual heat may be controlled when drawing multiple strokes to color an enclosed region, for example.

[System Configuration]

Figure 8:
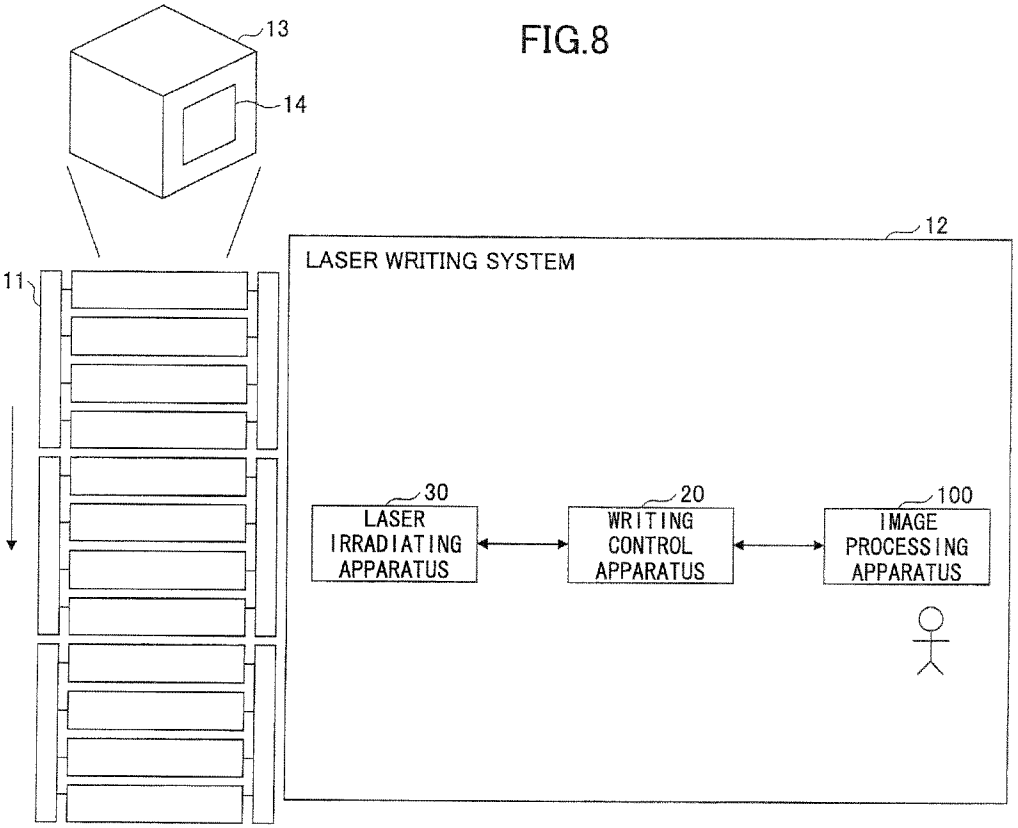
FIG. 8 is a diagram showing an exemplary configuration of a laser writing system according to an embodiment of the present invention.

FIG. 8 is a diagram showing an exemplary configuration of a laser writing system 12 according to an embodiment of the present invention. In FIG. 8, a container 13 moves along a conveyor 11, and rewritable paper 14 is fixed, attached, or removably placed on the container 13. The laser writing system 12 is arranged along the conveying path of the conveyor 11 so that it may face opposite the rewritable paper 14. The laser writing system 12 may detect when the container 13 passes by using a sensor, for example, and may draw an object including characters, numbers, symbols, and/or figures such as that shown in FIG. 3.

The laser writing system 12 includes a laser irradiating apparatus 30, a writing control apparatus 20, and an image processing apparatus 100. The image processing apparatus 100 accepts user operation inputs, provides information such as label data to the writing control apparatus 20, and issues a drawing request. The writing control apparatus 20 is an information processing apparatus that generates a control command based on the label data obtained from the image processing apparatus 100 and controls the laser irradiating apparatus 30 based on the control command. The laser irradiating apparatus 30 irradiates laser on rewritable paper and controls the laser irradiating position of the laser to draw an object such as characters on the rewritable paper. It is noted that the above configuration of the laser writing system 12 is merely an illustrative example, and in other embodiments, the functions of the image processing apparatus 100 and the writing control apparatus 20 may be interchanged. For example, the image processing apparatus 100 may be arranged to generate a control command based on the label data. In another example, the image processing apparatus 100 and the writing control apparatus 20 may be combined into a single apparatus. In other examples, the writing control apparatus 20 may be arranged to perform one or more functions of the image processing apparatus 100 described above.

Figure 9:
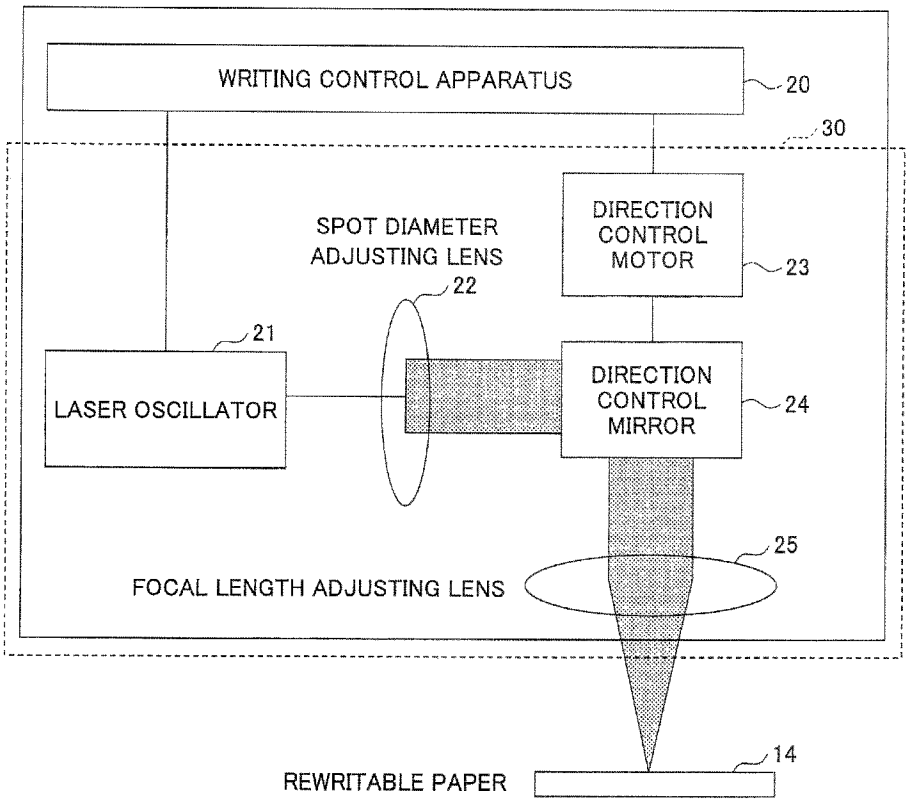
FIG. 9 is a diagram showing an exemplary hardware configuration of a laser irradiating apparatus that is connected to the writing control apparatus.

FIG. 9 is a diagram showing an exemplary hardware configuration of the laser irradiating apparatus 30 that is connected to the writing control apparatus 20. The laser irradiating apparatus 30 includes a laser oscillator 21 that irradiates laser, a direction control mirror 24 that changes the direction of laser, a direction control motor 23 that drives the direction control mirror 24, a spot diameter adjusting lens 22, and a focal length adjusting lens 25.

In the present embodiment, the laser oscillator 21 is a semiconductor laser (LD: laser diode). However, in other embodiments, the laser oscillator 21 may be a gas laser, a solid-state laser, or a liquid laser, for example. The direction control motor 23 may be a servomotor that controls the direction of reflection surfaces of the direction control mirror 24 along two axes, for example. In the present embodiment, the direction control motor 23 and the direction control mirror 24 realize a galvano mirror. The spot diameter adjusting lens 22 adjusts the spot diameter of laser light. The focal length adjusting lens 25 adjusts the focal length of laser light by converging the laser light.

When the writing control apparatus 20 supplies a duty cycle PWM signal based on a laser output control value and a voltage or an electric current based on a control value included in a control command to the laser oscillator 21, a beam with an intensity adjusted according to the control values may be irradiated. In the case of adjusting the drawing speed, the writing control apparatus 20 first obtains the laser scanning angle. Since the distance between the laser irradiating apparatus 30 and the rewritable paper 14 is fixed, the laser scanning angle may be obtained by determining the direction of the angle control mirror 24 for irradiating laser on the starting point of a stroke or line segment and the direction of the angle control mirror 24 for irradiating laser on the end point of the stroke or line segment. The writing control apparatus 20 may vary the laser irradiating position of the angle control mirror 24 from the starting point direction to the end point direction based on a drawing speed control value included in the control command. For example, in the case of using a galvano mirror, the direction of the angle control mirror 24 may be controlled by a voltage applied to a coil in a magnetic field. A conversion table for converting an X-axis direction and a Y-axis direction into a voltage may be provided beforehand, and the drawing speed may be changed at a constant angular velocity based on the drawing speed control value included in the control command.

The rewritable paper 14 includes a protective layer, a recording layer including a thermo-reversible film, a base layer, and a back coat layer that are arranged in this order from the top side towards the bottom side. The rewritable paper 14 is preferably provided with a certain degree of flexibility as well as durability so that it may be reused multiple times. It is noted that the rewritable paper 14 is not limited to a medium made of plant fiber such as paper and may also be a medium made of inorganic matter, for example.

The rewritable paper 14 includes a rewritable display region corresponding to a reversible display region on which objects may be rewritten. The rewritable display region may include a reversible thermo-sensitive medium such as a thermo-chromic film. The reversible thermo-sensitive medium may be of a type that can reversibly change transparency depending on the temperature, or a type that can reversibly change color tone depending on the temperature. In the present embodiment, a thermo-reversible film that includes leuco dye and a color developer in the recording layer to realize rewritable characteristics used as a reversible thermo-sensitive medium that can reversibly change color tone depending on the temperature.

It is noted that color may be developed from a decolored state by heating the leuco dye and the color developer to their melting point (e.g., 180° C.) to cause bonding of the materials and then rapidly cooling the materials. In this case, the dye and the color developer may be aggregated while they are still bound together to form a colored state.

On the other hand, decoloring may be realized by reheating the leuco dye and the color developer to a temperature that would not cause the materials to melt (e.g., 130-170° C.). In this case, the bond between the leuco dye and the color developer may be broken and the color developer may crystallize on its own to form a decolored state.

It is noted that the leuco dye used in the present embodiment may be any type of colorless or light-colored dye precursor that may be selected from conventionally known types of dye precursors.

The image processing apparatus 100 of the present embodiment is configured to draw an object on a rewritable recording medium with desirable coloration quality. The image processing apparatus 100 may also be configured to draw an object on a non-rewritable (write-once) recording medium. In one embodiment, the drawing speed and the laser output may be adjusted according to the sensitivity of the recording medium. That is, the appropriate drawing speed and laser output for drawing on a rewritable recording medium may differ from the appropriate drawing speed and laser output for drawing on a non-rewritable recording medium. Thus, the drawing speed and laser output may be adjusted to appropriate ranges for drawing an object on a non-rewritable recording medium. Also, it is noted that laser irradiation control according to an embodiment of the present invention may be realized without a recording medium.

Figure 10A:
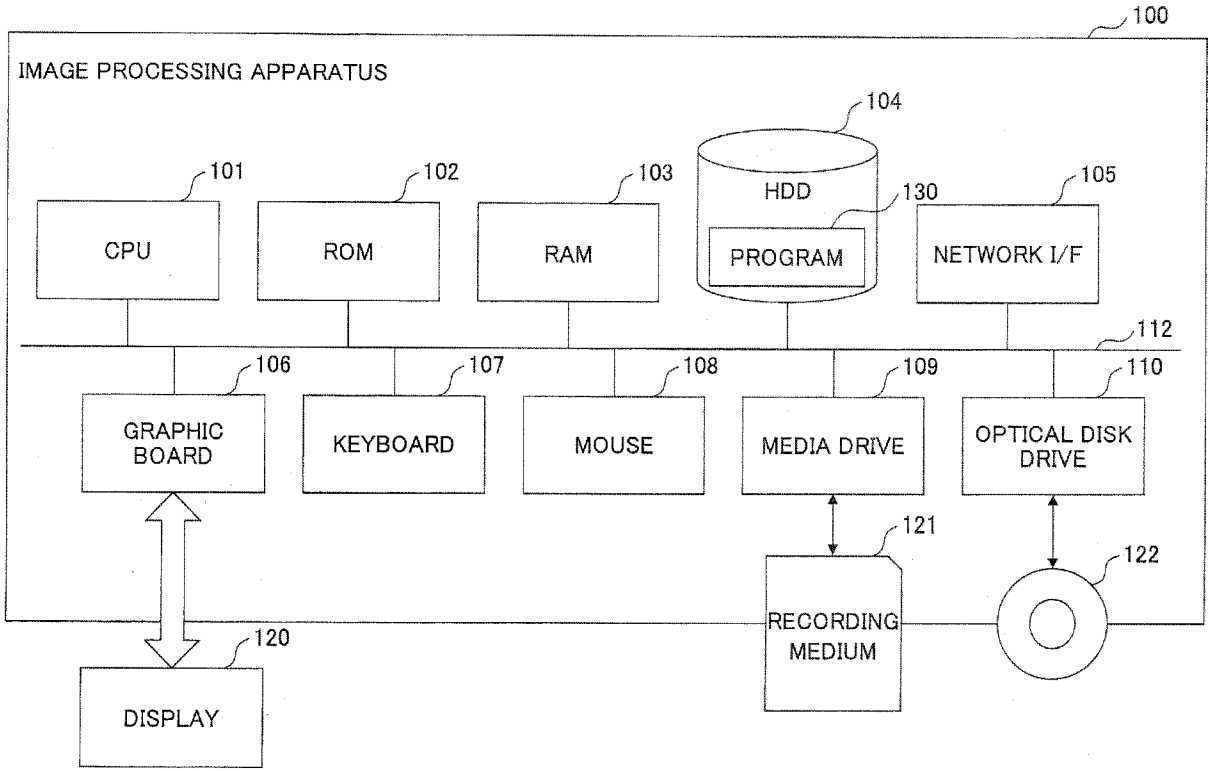
FIGS. 10A-10B are block diagrams showing exemplary hardware configurations of an image processing apparatus and the writing control apparatus.

FIG. 10A is a block diagram showing an exemplary hardware configuration of the image processing apparatus 100. It is noted that the image processing apparatus 100 may be a conventional information processing apparatus such as a personal computer, a workstation, a tablet computer, for example.

The image processing apparatus 100 includes a CPU 101, a ROM 102, a RAM 103, a HDD 104, a network interface 105, a graphic board 106, a keyboard 107, a mouse 108, a media drive 109, and an optical disk drive 110. The CPU 101 executes a program 130 stored in the HDD 104 and performs overall control of the image processing apparatus 100. The ROM 102 stores IPL (Initial Program Loader) and static data. The RAM 103 is used by the CPU 101 as a working area to execute the program 130 stored in the HDD 104.

The HDD 104 stores the program 130 and OS (operating system) to be executed by the CPU 101. The program 130 is run on the image processing apparatus 100 to generate a control command based on configuration information such as the frame and the tips of a figure to be drawn, for example. The network interface 105 may be an Ethernet (registered trademark) card, for example, that establishes connection between the image processing apparatus 100 and a network. It is noted that the network interface 105 operate mainly in layers 1 and 2. Functions and services provided by layers 3 or higher may be performed by a TCP/IP protocol stack or program included in the OS.

The graphic board 106 interprets a drawing command written by the CPU 101 on a video RAM and displays various items of information such as a window, a menu, a cursor, characters, and/or an image on a display 120.

The keyboard 107 includes keys representing characters, numerical values, an symbols for inputting various commands. The keyboard 107 accepts a user operation input and notifies the CPU 101 of the user input. Similarly, the mouse 108 accepts a user operation input such as the movement of a cursor or the selection of a process from a menu, for example.

The media drive 109 controls reading and writing (recording) of data on a recording medium 121 such as a flash memory. The optical disk drive 110 controls reading and writing of data on a removable optical medium 122 such as a Glu-ray disk, a CD, or a DVD, for example. The image processing apparatus 100 also includes a bus line 112 for establishing electrical connection between the above hardware components.

In one embodiment, the program 130 may be recorded on a computer-readable medium such as the recording medium 121 or the optical medium 122 in a computer-installable and computer-executable file format. In another embodiment, the program 130 may be downloaded in the image processing apparatus 100 from a server (not shown) as a computer-installable and computer-executable file.

Figure 10B:
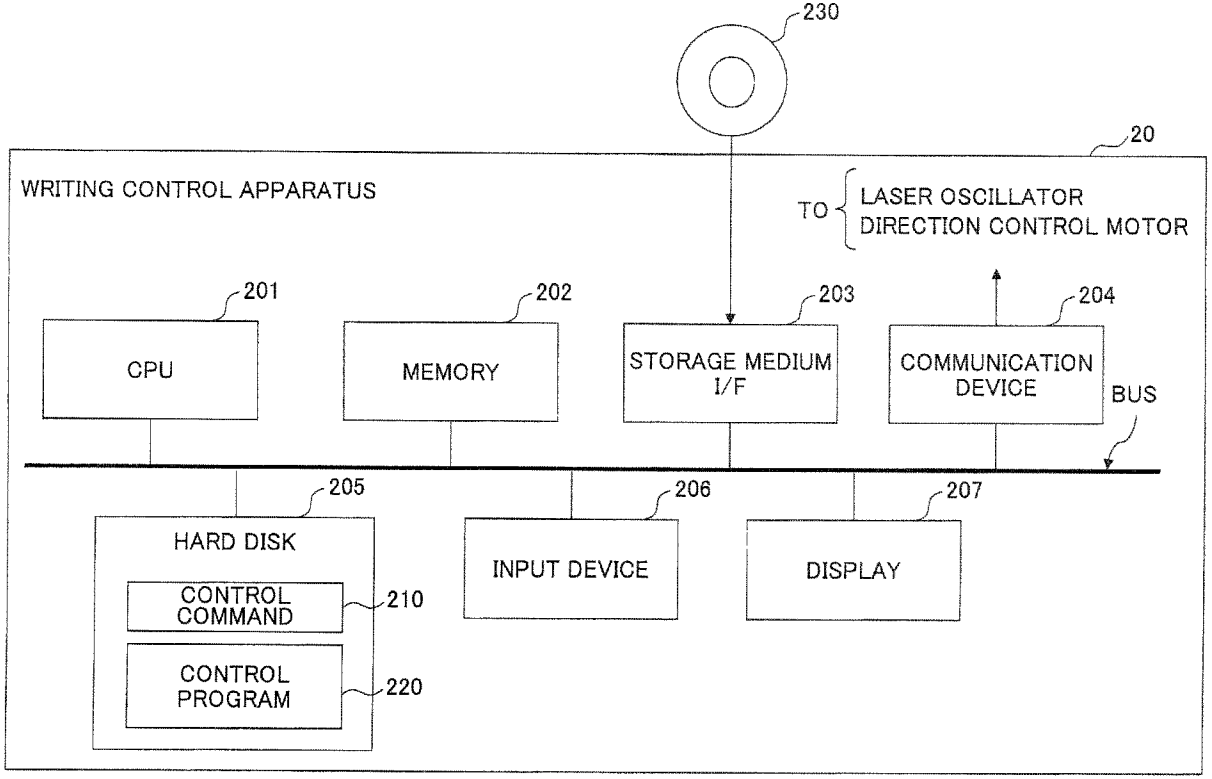

FIG. 10B is a block diagram showing an exemplary hardware configuration of the writing control apparatus 20. It is noted that FIG. 10B illustrates an exemplary case in which the writing control apparatus 20 is realized by a computer and functions of the writing control apparatus 20 are implemented mainly by software. It is noted that in other embodiments, the writing control apparatus 20 may be realized without using a computer by using an IC dedicated for a specific function such as an ASIC (Application Specific Integrated Circuit).

The writing control apparatus 20 includes a CPU 201, a memory 202, a storage medium interface 203, a communication device 204, a hard disk 205, an input device 206, and a display 207. The hard disk 205 stores a control command DB 210 that has control commands for coloring a figure, or drawing a character, a number, or a symbol registered therein, and a control program 220 for controlling the laser oscillator 21 and the direction control motor 23 based on a control command.

The CPU 201 reads the control program 220 from the hard disk 205 and executes the control program 220 to draw an object such as characters on the rewritable paper 14. The memory 202 may be a volatile memory such as a DRAM (Dynamic Random Access Memory) that may be used by the CPU 201 as a working area for executing the control program 220. The input device 206 may include devices such as a keyboard and/or a mouse that enable a user to input a control command for controlling the laser irradiating apparatus 30. The display 207 is a user interface that displays a GUI (Graphic User Interface) screen at a predetermined resolution and a predetermined color depth based on screen information designated by the control program 220, for example. The display 207 may display an entry field for entering a character or object to be drawn on the rewritabie paper 14, for example.

The storage medium interface 203 may have a removable storage medium 230 installed therein. The storage medium interface 203 is used to read data from the storage medium 230 and/or write data on the storage medium 230. In one embodiment, the control program 220 and the control command DB 210 may be stored in the storage medium 230 and distributed in this manner. In this case, the control program 220 and the control command DB 210 may be read from the storage medium 230 and installed in the hard disk 205. In another embodiment, the control program 220 and the control command DB 210 may be downloaded from a predetermined server that is connected to the writing control apparatus 20 via a network.

The storage medium 230 is a non-volatile memory that is removable and portable such as a Blu-ray disk, a CD, a DVD, a SD card, a multimedia card, or an xD card. The communication device 204 is used for sending a control command to the laser oscillator 21 or the direction control motor 23 and may be an Ethernet card or a serial communication device such as a USB (Universal Serial Bus), an IEEE 1394 port, or a Bluetooth (registered trademark) port, for example.

Figure 11:
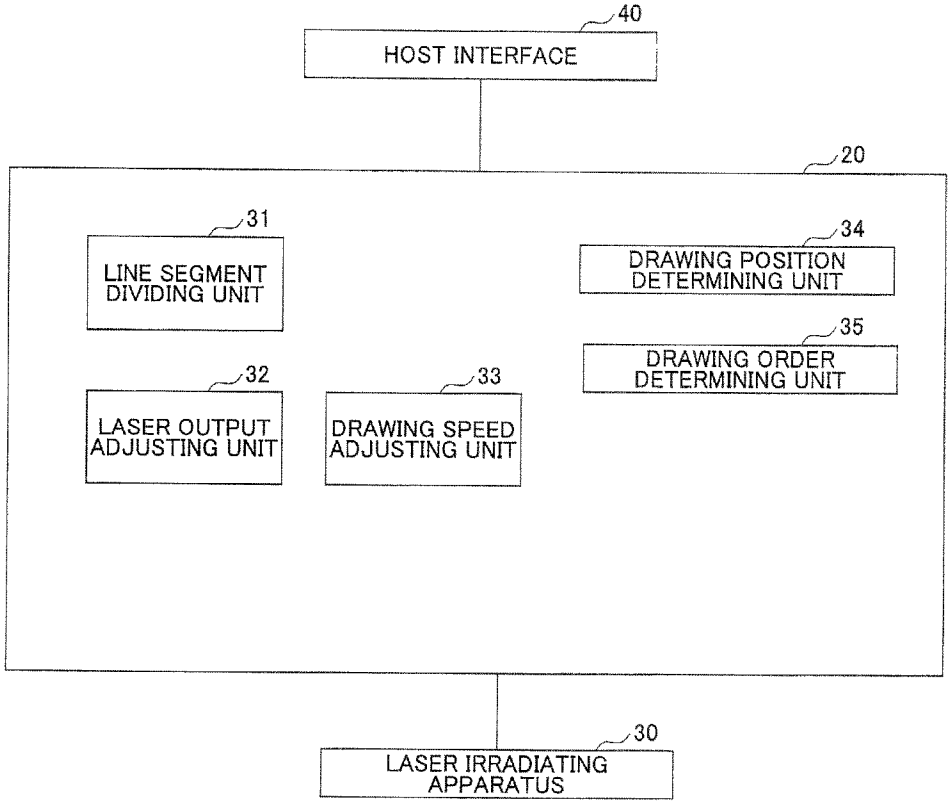
FIG. 11 is a block diagram showing an exemplary functional configuration of the writing control apparatus.

FIG. 11 is a block diagram showing an exemplary functional configuration of the writing control apparatus 20. In FIG. 11, the writing control apparatus 2C is connected to a host interface 40 and the laser irradiating apparatus 30. The host interface 40 is for establishing connection with a network or the image processing apparatus 100. The host interface 40 obtains data of an object to be drawn on a label from the image processing apparatus 100. For example, the host interface 40 may obtain a digit sequence that is to be converted into a barcode, configuration information of a barcode or a figure, or font data or configuration information of a character, a number, or a symbol to be drawn. It is noted that the host interface 40 is an exemplary embodiment of a line segment information obtaining unit of the present invention.

The writing control apparatus 20 includes a line segment dividing unit 31, a laser output adjusting unit 32, a drawing speed adjusting unit 33, a drawing position determining unit 34, and a drawing order determining unit 35. It is noted that these functional units of the writing control apparatus 20 may be realized by the CPU 201 executing the control program 220 to perform various functions in cooperation with the hardware components of the writing control apparatus 20 shown in FIG. 105, for example.

The drawing position determining unit 34 obtains position information of an object to be drawn such as a barcode or a figure and generates stroke information of strokes to be drawn such as that shown in FIG. 65 to color a region defined by an outer frame. It is noted that the pitch may be fixed or designated by a user.

The drawing order determining unit 35 arranges the positions of the staring points and the end points of adjacent strokes to alternate in the manner shown in FIG. 6C, for example, so that the drawing time may be reduced. Also, the drawing order determining unit 35 determines the order in which the strokes are to be drawn. For example, the drawing order determining unit 35 may have the strokes drawn in order from one side to the other starting from the rightmost or leftmost stroke.

The line segment dividing unit 31 divides a backward stroke into line segments. It is noted that details of the line segment dividing unit 31 are described below.

The drawing speed adjusting unit 33 assigns a drawing speed to a control command for drawing a line segment after a stroke is divided into plural line segments by the line segment dividing unit 31. That is, before a stroke is divided into line segments by the line segment dividing unit 31, only one drawing speed c value is designated in the control command for drawing the stroke. Accordingly, after the stroke is divided into plural line segments, a drawing speed control value is assigned to each of the line segments. The drawing speed control values for the line segments may be adjusted so that a faster drawing speed is assigned to a line segment that is located at a region that receives a greater impact from residual heat. In this way, the rewritable paper 14 may be prevented from overheating, for example. Also, a slower drawing speed may be assigned to a line segment that is located at a region that receives less impact from residual heat. In this way, the temperature of the rewritable paper 14 may be raised to an adequate level for drawing the line segment, for example. It is noted that the drawing speed is adjusted with respect to the normal drawing speed. As in the examples shown in FIGS. 7A and 7B, when the normal drawing speed is the slowest drawing speed, a drawing speed that is slower than the normal drawing speed may not be used.

The laser output adjusting unit 32 assigns a laser output control value to a control command for drawing a line segment after a stroke is divided into plural line segments by the line segment dividing unit 31. That is, before a stroke is divided into line segments by the line segment dividing unit 31, only one laser output control value is designated in the control command for drawing the stroke. Accordingly, after the stroke is divided into plural line segments, a laser output control value is assigned to each of the line segments. The laser output control values for the line segments may be adjusted so that a lower laser output control value is assigned to a line segment that is located at a region that receives a large impact from residual heat. In this way, the rewritable paper 14 may be prevented from overheating, for example. Also, a higher laser output control value is assigned to a line segment that is located at a region that receives less impact from residual heat. In this way, the rewritable paper 14 may be heated to an adequate temperature for drawing the line segment. It is noted that the laser output control values for the line segments is adjusted with respect to a normal laser output value.

The drawing speed adjusting unit 33 and the laser output adjusting unit 32 of the writing control apparatus 20 are exemplary embodiments of a control factor adjusting unit of the present invention. Also, it is noted that although both the laser output and the drawing speed are adjusted in the above example, in other embodiments, only one of the above laser output control operations or the drawing speed control operations may be performed.

[Line Segment Division]

FIGS. 12A-12B and FIGS. 13-15 are diagrams showing an exemplary manner of dividing a stroke into plural line segments.

Figures 12A, 12B:
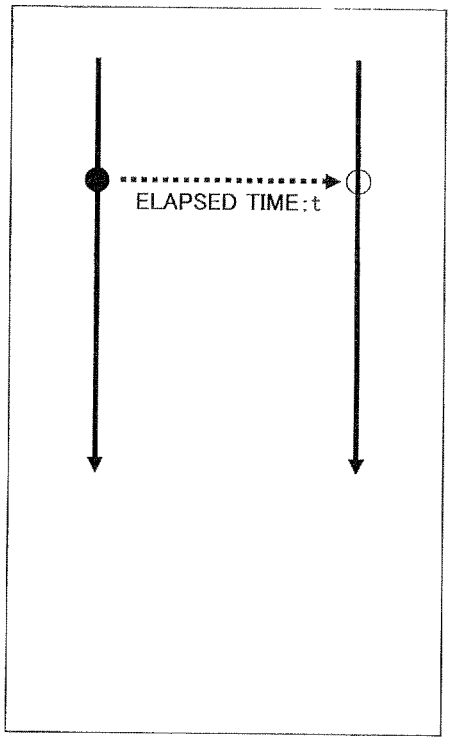
FIGS. 12A-12B illustrate a predetermined time period that must elapse before the impact of residual heat from drawing a stroke may be disregarded.

FIG. 12A illustrates the time t that must elapse before the impact of residual heat from drawing an adjacent line may be disregarded. When drawing a stroke from a top side to a bottom side, for example, a given point of the stroke (e.g., circle shown in FIG. 12A) is scanned by a laser beam. With regard to this given point, heat starts to be released immediately after the laser beam passes this given point, d after some time period elapses, the temperature at the given point may decrease to a predetermined threshold value or lower. When the temperature falls below the predetermine threshold value, it may be deemed that no residual heat remains at the given point. In the present example, the predetermined time t represents the time period from when the laser beam passes a given point until the temperature at the given point falls below the predetermined threshold value.

The time t may be obtained through experiment (or simulation) by scanning a laser beam at a normal laser output level on a region and monitoring the temperature change at this region, for example. It is noted that since the time t may vary depending on the environmental temperature, in one preferred embodiment, the time t may be set equal to different values according to the environmental temperature. Also, since the time t may vary depending on the laser output level, the time t may be set equal to different values according to the laser output level.

FIG. 12B is a table showing an example in which time t is set equal to different values according to the laser output level and the environmental temperature. For example, when the environmental temperature is T1 and the laser output level is P(1), time t is equal to t1; when the environmental temperature is T2 and the laser output level is P(2), time t is equal to t2; and when the environmental temperature is T3 and the laser output level is P(3), time t is equal to t3. In a case where $P(1)<P(2)<P(3)$, $t1<t2<t3$. In another embodiment, instead of determining the values of time t beforehand, a user may input the value of time t to the writing control apparatus 20.

Figure 13:
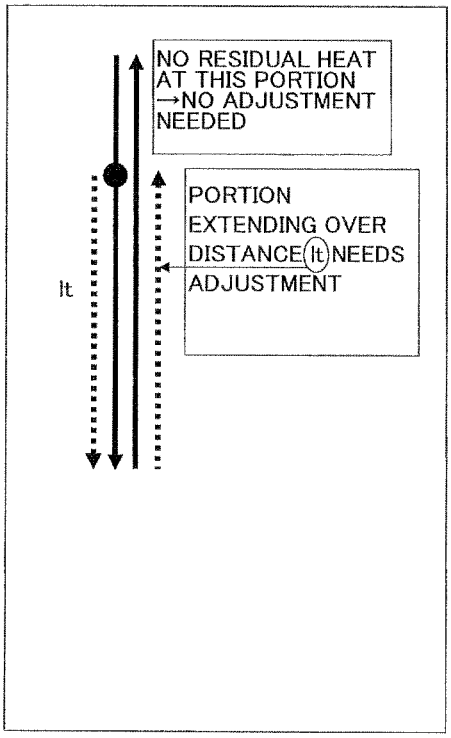
FIG. 13 illustrates an exemplary relationship between the predetermined time and a drawing distance.

FIG. 13 shows an exemplary relationship between the time t and a drawing distance. If the time period from the time a laser beam passes a given point of a forward stroke until the time the laser beam passes a corresponding adjacent point of a backward stroke is longer than time t, it may be determined that the portion of the backward stroke drawn after this point may not be affected by residual heat. The distance between the starting point of the backward stroke and the given point (referred to as "distance lt" hereinafter) is equal to half the total drawing distance scanned during time t. That is, equal-distance portions of the forward stroke and the backward stroke are drawn during time t. In the present example, the portion of the backward stroke extending over the distance lt is determined so that the drawing speed and/or the laser output level may be adjusted for drawing this portion.

The line segment dividing unit 31 multiplies the predetermined time t by the normal drawing speed S(x) to obtain the drawing distance of the laser spot 1U light over time t. The distance lt is half this drawing distance so that it may be obtained by the following formula:

$$lt=(1/2)\times S(x)\times t$$

It is noted that the normal drawing speed S(x) corresponds to a drawing speed that is normally used to obtain desirable coloration (density) using a normal laser output under a normal condition free from influences of residual heat (or where influences of residual heat may be disregarded). The writing control apparatus 20 according to the present embodiment is configured to adjust the drawing speed for drawing the line segments of the portion of the backward stroke extending over the distance lt to a drawing speed that is faster than the above normal drawing speed S(x). It is noted that in certain embodiments, the normal drawing speed S(x) may be adjustable. However, in the following descriptions, it is assumed that the normal drawing speed S(x) is fixed.

Also, it is noted that once the value of time t is determined based on the normal drawing speed S(x), the distance lt may be unambiguously determined. Thus, in certain embodiments, the distance it may be determined beforehand as well as the value of time t.

Figure 14:
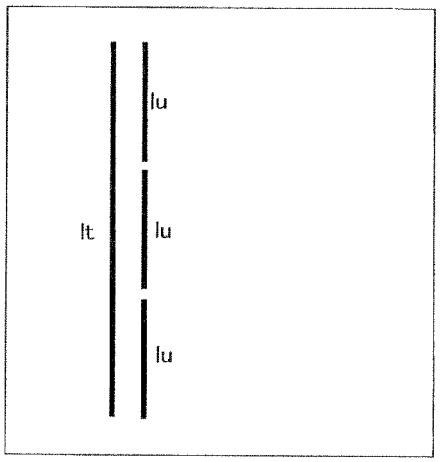
FIG. 14 is a diagram showing an exemplary manner of dividing a stroke into line segments.

FIG. 14 is a diagram showing an exemplary manner of dividing a stroke into line segments. The line segment dividing unit 31 divides the distance lt by a natural number n. The natural number n may represent the number of different drawing speeds aside from the normal drawing speed to which the drawing speed for drawing the line segments may be adjusted. Also, the natural number n may represent the number of different laser output levels aside from the normal laser output level to which the laser output level for drawing the line segments may be adjusted. For example, in a case where the drawing speed may be adjusted to ten different levels excluding the normal drawing speed, n=10. In a case where the laser output level may be adjusted to ten different levels excluding the normal laser output level, n=10. In a case where the drawing speed and the laser output level may each be adjusted to ten different levels, n=100 (10×10). In the example described below, it is assumed that n=3. It is noted that the coloration (density) of the backward stroke may be controlled with higher accuracy as the value of n is increased.

A length lu of each line segment may be obtained by dividing the distance it by the number of adjustment levels n, as is shown below.

$$lu=lt/n$$

It is noted that since the distance lt may be determined regardless of the length of the stroke to be drawn, the length lu may also be determined regardless of the stroke length.

The line segment dividing unit 31 divides a stroke to be drawn into line segments each having the length lu. Assuming lo represents the stroke length, a division number m corresponding to a number of line segments into which the stroke may be divided may be determined by dividing the stroke length lo by the line segment length lu as is shown below.

$$m=lo/lu \text{ (rounded up to the nearest whole number)}$$

It is noted that the division of the stroke into line segments described above represents a division (switching) of the control value for drawing the stroke but does not represent performing laser ON/OFF a operations multiple times to draw the stroke. That is, in the present embodiment, even when the stroke is divided into plural line segments, the laser remains ON during the entire time the stroke is drawn.

The line segment dividing unit 31 divides a backward stroke into line segments of length lu from the starting point of the backward stroke. It is noted that the control value is not adjusted for the portion of the backward stroke after the $(n+1)^{th}$ line segment so that there is little need to divide the stroke into further line segments. Accordingly, in one embodiment, the line segment dividing unit 31 may stop the line segment division process after dividing the stroke into (n+1) line segments.

[Drawing Speed and Laser Output Adjustment]

Figure 15:
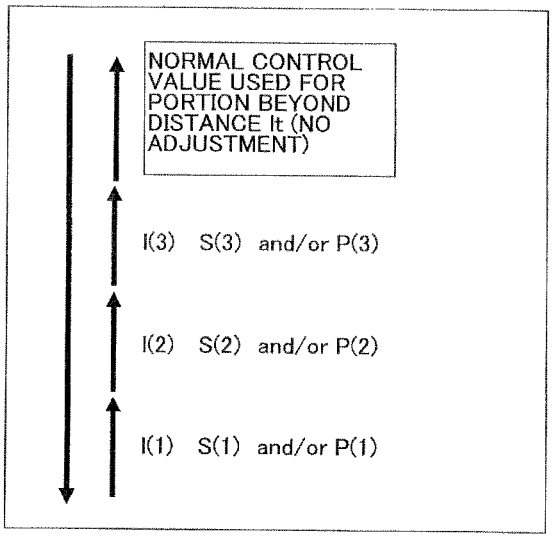
FIG. 15 is diagram showing an exemplary manner of adjusting the drawing speed and/or the laser output level for drawing each line segment.

FIG. 15 is a diagram showing an exemplary manner of adjusting the drawing speed and/or the laser output for drawing each line segment. In the illustrated example of FIG. 15, a backward stroke is divided into three line segments, l(1)-l(3), over the distance lt from the starting point of the backward stroke. In the present embodiment, the drawing speed adjusting unit 33 and/or the laser output adjusting unit 32 adjusts the drawing speed control values and/or the laser output control values used for drawing the line segments l(1)-l(3).

It is assumed that the drawing speed control values and the laser output control values used for drawing the line segments are denoted as follows:

S(1)-S(n): drawing speed control values used for line segments l(1)-l(n)

P(1)-P(n): laser output control values used for line segments l(1)-l(n)

The "1" and "n" inside the parentheses represent the line segment number from the starting point.

In the illustrated example, the drawing speed adjusting unit 33 may adjust the drawing speed control value for the line segment l(1) to S(1), the drawing speed control value for the line segment l(2) to S(2), the drawing speed control value for the line segment l(3) to S(3). The laser output adjusting unit 32 may adjust the laser output control value for the line segment l(1) to P(1), the drawing speed control value for the line segment l(2) to P(2), the drawing speed control value for the line segment l(3) to P(3).

In one embodiment, both the drawing speed adjusting unit 33 and the laser output adjusting unit 32 may adjust the control values for drawing the line segments as follows:

P(1) and S(1) used for line segment l(1)

P(2) and S(2) used for line segment l(2)

P(3) and S(3) used for line segment l(3)

It is noted that the normal drawing speed and the normal laser output (normal control values) are used to draw the portion of the backward stroke beyond distance lt. That is, the drawing speed and the laser output do not need to be adjusted for this portion.

FIG. 16 is a table showing an exemplary control command that designates control values for drawing a line segment. In the present embodiment, such a control command is generated for each line segment. In FIG. 16, control values are represented by bytes. For example, the first four bytes (i.e., bytes 0-3) represent the X and Y coordinates of the starting point, and bytes 4-7 represent the X and Y coordinates of the end point of the line segment. Bytes 8 and 9 represent the laser output control value, and bytes 10 and 11 represent the drawing speed control value.

In the present embodiment, the X and Y coordinates of the starting point and end point of the line segment may be determined when the line segment dividing unit 31 divides a stroke into line segments. The laser output control value may be determined when the laser output adjusting unit 32 determines the laser output control value to be used for the line segment. The drawing speed control value may be determined when the drawing speed adjusting unit 33 determines the drawing speed control value to be used for the line segment.

[Operations]

Figure 17:
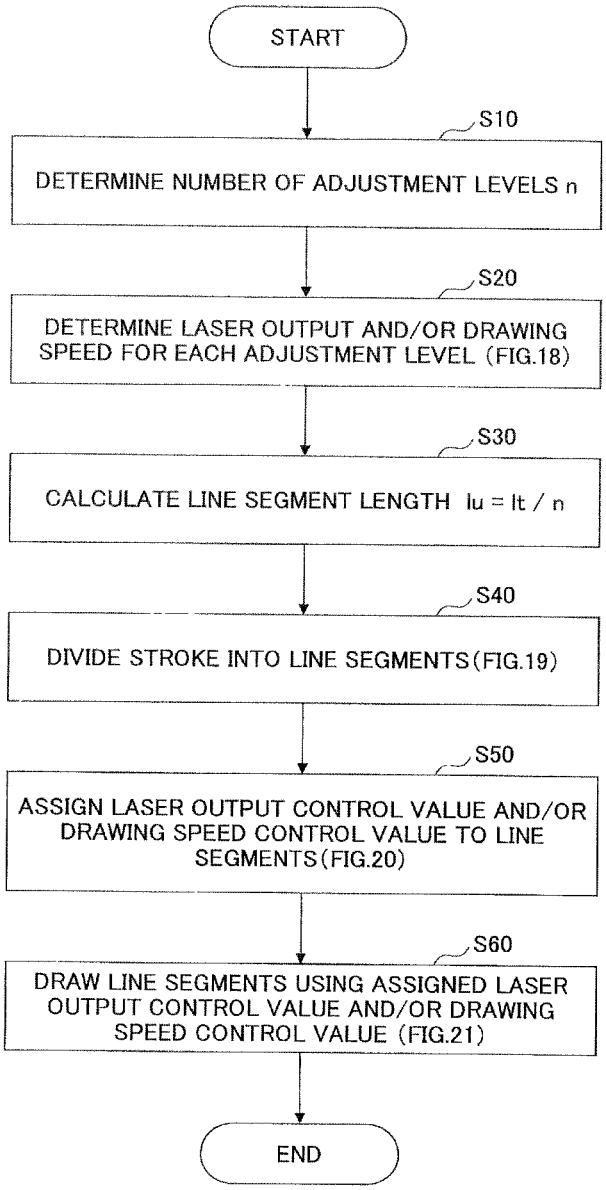
FIG. 17 is a flowchart showing exemplary process steps performed by the writing control apparatus to adjust control values of the drawing speed and/or the laser output level.

FIG. 17 is a flowchart showing exemplary process steps performed by the writing control apparatus 20 to adjust the drawing speed and/or laser output. The process shown in FIG. 17 may be started when a user inputs a command to generate a drawing object such as a barcode or a figure.

When the process is started, the line segment dividing unit 31 determines the number of adjustment levels n into which the control value can be adjusted (S10). In the present example, it is assumed that the number of adjustment levels n is determined beforehand.

Then, the laser output adjusting unit 32 and/or the drawing speed adjusting unit 33 determines the laser output and/or the drawing speed for each adjustment level (S20). It is noted that detailed process steps of step S20 are described below with reference to FIG. 18.

Then, the line segment dividing unit 31 calculates the length lu of the line segment into which a stroke is to be divided based on the formula lu=lt/n (S30).

Then, the line segment dividing unit 31 divides a stroke into line segments with length lu (S40). It is noted that detailed process steps of step S40 are described below with reference to FIG. 19.

Then, the laser output adjusting unit 32 and/or the drawing speed adjusting unit 33 assigns a drawing speed control value and/or a laser output control value to each line segment (S50). It as noted that detailed process steps of step S50 are described below with reference to FIG. 20.

Then, the writing control apparatus 20 draws the drawing object such as a barcode based on a control command designating the drawing speed control value and/or the laser output control value assigned to each line segment (S60).

Figure 18:
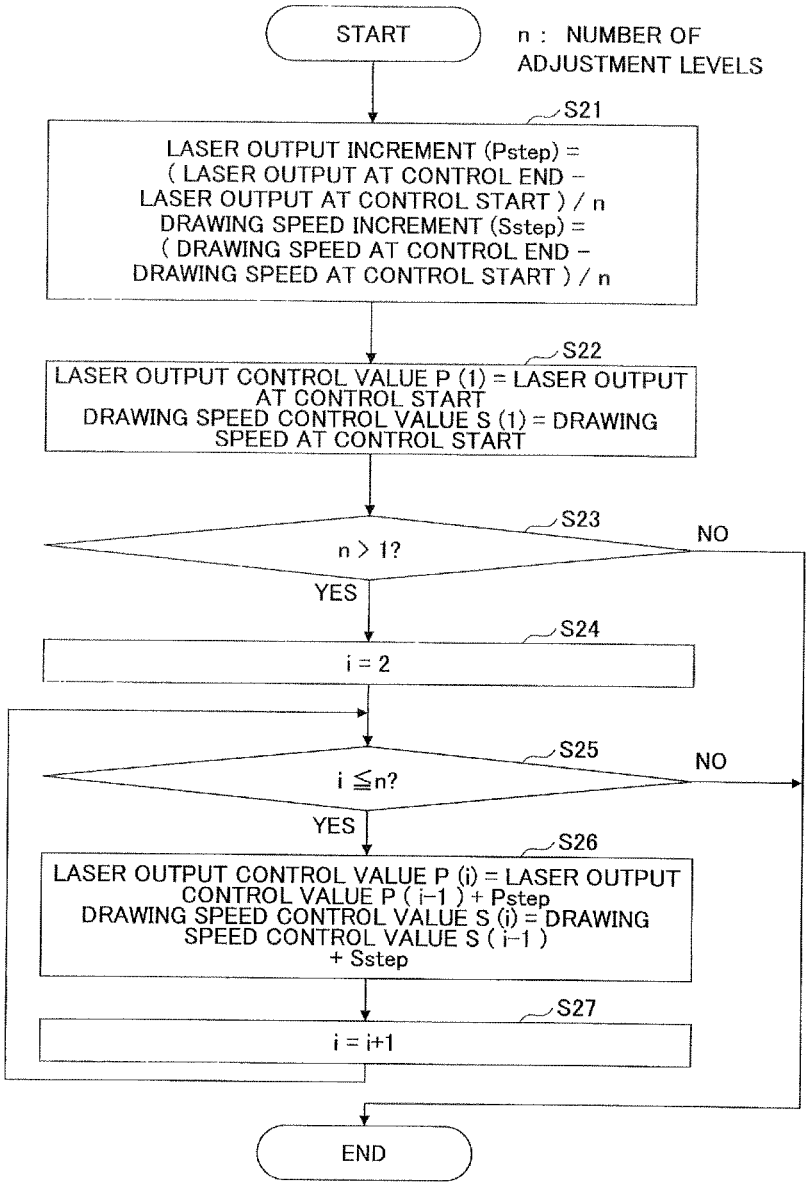
FIG. 18 is a flowchart showing exemplary detailed process steps of step S20 of FIG. 17.

FIG. 18 is a flowchart showing exemplary process steps of step S20 for determining the laser output and/or the drawing speed for each adjustment level.

First, the drawing speed adjusting unit 33 and the laser output adjusting unit 32 obtains the laser output increment value and the drawing speed increment value based on the following formulas (S21).

Laser output increment ($P$step)=(laser output it control value at control end−laser output control value at control start)/$n$ Drawing speed increment ($S$step)=(drawing speed control value at control end−drawing speed control value at control start)/$n$ It is noted that the laser output control value at control end corresponds to the greatest laser output control value of the n levels of laser output control values (i.e., laser output that is one level below the normal laser output). The laser output control value at control start corresponds to the smallest laser output control value of the n levels of laser output control values. The drawing speed control value at control end corresponds to the slowest drawing speed control value of the n levels of drawing speed control values (i.e., drawing speed one level faster than the normal drawing speed). The drawing speed control value at control start corresponds to the fastest drawing speed control value of the n levels of drawing speed control values.

Next, the drawing speed adjusting unit 33 sets the drawing speed control value S(1) equal to the drawing speed control value at control start. Similarly, the laser output adjusting unit 32 sets the laser output control value P(1) equal to the laser output control value at control start (S22).

Then, the drawing speed adjusting unit 33 and/or the laser output adjusting unit 32 determines whether n is greater than 1 (n>1?) (S23).

If n is not greater than 1 (S23, NO), the number of adjustment levels n is equal to 1 (n=1) so that the control value determination process may be ended after the control values S(1) and P(1) are determined.

If n is greater than 1 (S23, YES), the drawing speed adjusting unit 33 and/or the laser output adjusting unit 32 sets a counter value i equal to 2 (i=2) (S24). The counter value i is used to determine whether conditions for ending the determination process of FIG. 18 have been satisfied.

Then, the drawing speed adjusting unit 33 and/or the laser output adjusting unit 32 determines whether the counter value i is less than or equal to the number of adjustment levels n (i≤n?) (S25).

If the counter value i is not less than or equal to the number of adjustment levels n (S25, NO), the determination process may be ended after the control values S(1) and P(1) are determined.

If the counter value i is less than or equal to the number of adjustment levels n (S25, YES), the drawing speed adjusting unit 33 and/or the laser output adjusting unit 32 adjusts the control values S(i) or P(i) based on the following formulas (S26):

Drawing speed control value $S(i)=S(i-1)+S\text{step}$

Laser output control value $P(i)=P(i-1)+P\text{step}$

Then, the drawing speed adjusting unit 33 and/or the laser output adjusting unit 32 increments the counter value i by 1 (i=i+1) (S27).

Then, the process returns to step S25 where the drawing speed adjusting unit 33 and/or the laser output adjusting unit 32 determines whether the counter value i is less than or equal to the number of adjustment levels n (i≤n?).

As can be appreciated, in the determination process of FIG. 18, the counter value i is incremented by 1 and the drawing speed control value and/or the laser output control value is incremented by the increment values Pstep and/or Sstep until the counter value i reaches a value exceeding the number of adjustment levels n.

Figure 19:
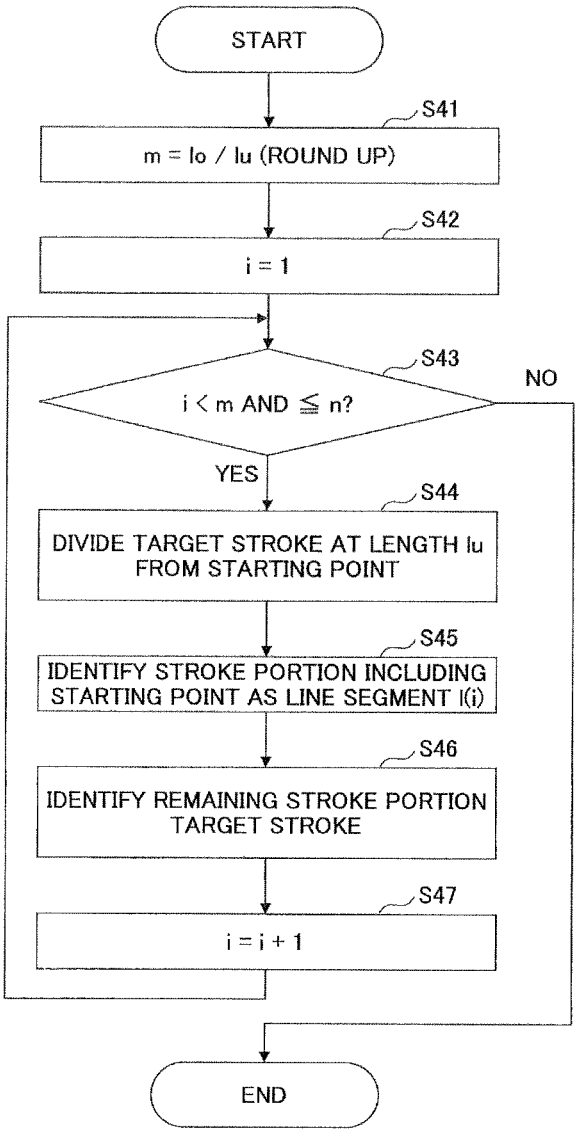
FIG. 19 is a flowchart showing exemplary detailed process steps of S40 of FIG. 17.

FIG. 19 is a flowchart showing exemplary process steps of S40 for dividing a stroke into line segments. It is noted that in the example shown in FIG. 19, the line segment dividing unit 31 is prevented from dividing a stroke into more than n+1 line segments. In alternative examples, the stroke may be divided into line segments regardless of the number of adjustment levels n.

First, the line segment dividing unit 31 calculates the division number m corresponding to the number of line segments into which a stroke may be divided (m=lo/lu) (S41). It is noted that when the quotient of lo/lu is not a whole number, it is rounded up to the nearest whole number to obtain the division number m.

Then, the line segment dividing unit 31 sets the initial value of the counter value i equal to "1" (i=1) (S42). Then, line segment dividing unit 31 repeats the following process steps while the counter value i is less than m (i<m) and less than or equal to n (i≤n) (S43, YES).

First, the stroke to be divided (original stroke) is divided at a division point at length lu from the starting point (S44).

The divided stroke portion extending from the starting point to the division point is identified as line segment l(i) (S45).

The remaining stroke portion excluding the line segment l(i) is then identified as the target stroke (S46).

Then, the line segment dividing unit 31 increments the counter value i by 1 (i=i+1) (S47).

Then, the process goes back to step S43 and a determination is made as to whether the counter value i is less than m (i<m) and less than or equal to n (i≤n). If the counter value i is greater than or equal to m (i≥m) or is greater than n (i>n) (S43, NO), the division process of FIG. 19 is ended. It is noted that when the division process of FIG. 19 is ended upon satisfying the former condition (i≥m), the counter value i at the time the process is ended corresponds to the number of line segments into which the stroke is divided. The counter value i at the time the process is ended by satisfying the latter condition (i>n) also corresponds to the number of line segments into which the stroke is divided since the division process is stopped when the line segment counter value i exceeds n. That is, regardless of whether the process of FIG. 19 is ended by satisfying the former condition or the latter condition, the counter value i at the time the division process is ended corresponds to the number of line segments into which the stroke is divided.

In another example, the determination condition used in step S43 may merely be based on whether the counter value i is greater than or equal to m (i≥m). In this case, the stroke may be divided into m line segments regardless of the number of adjustment levels n. When the division number m is greater than n, the line segments after the $(n+1)^{th}$ line segment may be assigned a normal drawing speed control value and/or a normal laser output control value as is described below.

In another example, the normal drawing speed control value and/or the normal laser output control value may be initially assigned to all the line segments right after the stroke is divided into line segments in step S40. In this case, the process of assigning the normal drawing speed control value and/or the normal laser output control value to the line segments after the $(n+1)^{th}$ line segment may be omitted.

Figure 20:
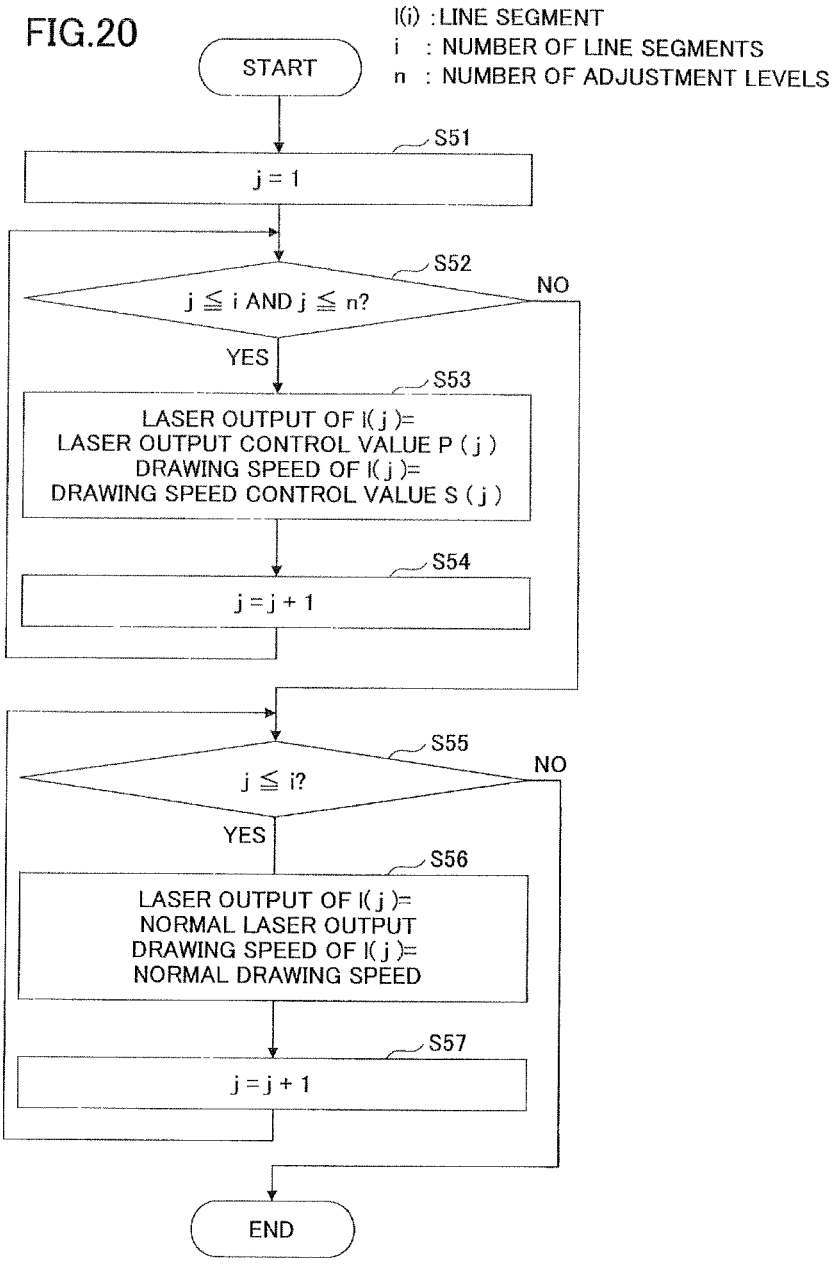
FIG. 20 is a flowchart showing exemplary detailed process steps of step S50 of FIG. 17.

FIG. 20 is a flowchart showing exemplary detailed process steps of step S50 of FIG. 17.

First, the drawing speed adjusting unit 33 and/or the laser output adjusting unit 32 sets the initial value of a counter value j equal to "1" (j=1) (step S51).

Then, the drawing speed adjusting unit 33 and/or the laser output adjusting unit 32 repeats the following process steps while j is less than or equal to i (j≤i) and less than or equal to n (j≤n) (S52, YES).

In step S53, the drawing speed adjusting unit 33 adjusts the drawing speed of line segment l(j) to drawing speed control value S(j) (line segment l(j) drawing speed=drawing speed control value S(j)), and/or the laser output adjusting unit 32 adjusts the laser output of line segment l(j) to laser output control value P(j) (line segment l(j) laser output=laser output control value P(j)).

In step S54, the drawing speed adjusting unit 33 or the laser output adjusting unit 32 increments the counter value j by 1 (j=j+1).

Then, the process goes back to step S52 and a determination is made as to whether the counter value j is greater than the number of line segments into which the stroke is divided i (j>i) or whether the counter value j is greater than n (j>n). If the counter value j is greater than i or greater than n (step S52, NO), the process proceeds to step S55. It is noted that since i corresponds to the number of line segments into which the stroke is divided, no line segments subject to control value adjustment will remain after the counter value j exceeds i. Also, after the counter value j exceeds the number of adjustment levels n, the normal drawing speed and/or the normal laser output may be used for the remaining line segments.

When the counter value j is greater than n (j>n) (S52, NO), one or more line segments that have not been assigned a control value may still remain if the counter value j is less than or equal to i (j≤i). Accordingly, in this case, the drawing speed adjusting unit 33 or the laser output adjusting unit 32 determines whether the counter value j is less than or equal to i (j≤i) (S55).

If the counter value j is not less than or equal to i (S55, NO), the control value adjustment process of FIG. 20 is ended.

If the counter value j is less than or equal to i (S55, YES), the drawing adjusting unit 33 or the laser output adjusting unit 32 repeats the following process steps.

In step S56, the drawing speed adjusting unit 33 adjusts the drawing speed of line segment l(j) to the normal drawing speed control value (drawing speed of line segment l(j)=normal drawing speed control value), and/or the laser output adjusting unit 32 adjusts the laser output of line segment l(j) to the normal laser output control value (laser output of line segment l(j)=normal laser output control value).

In step S57, the drawing speed adjusting unit 33 and/or the laser output adjusting unit 32 increments the counter value j by 1 (j=j+1).

The process then goes back to step S55 to determine whether j is less than or equal to i (j≤i). When the counter value j exceeds i, the control value adjustment process of FIG. 20 is ended.

It is noted that the above control value adjustment process of FIG. 20 may be the same even in the case where the stroke is divided into line segments regardless of the number of adjustment levels n (when the determination condition of step S43 of FIG. 19 is merely based on whether the counter value i is greater than or equal to m). In this case, after the counter value j is determined to be greater than n (j>n) in step S52, the process proceeds to step S55, and the normal drawing speed control value and/or the normal laser output control value is assigned to the line segments after the $(n+1)^{th}$ line segment.

Figure 21:
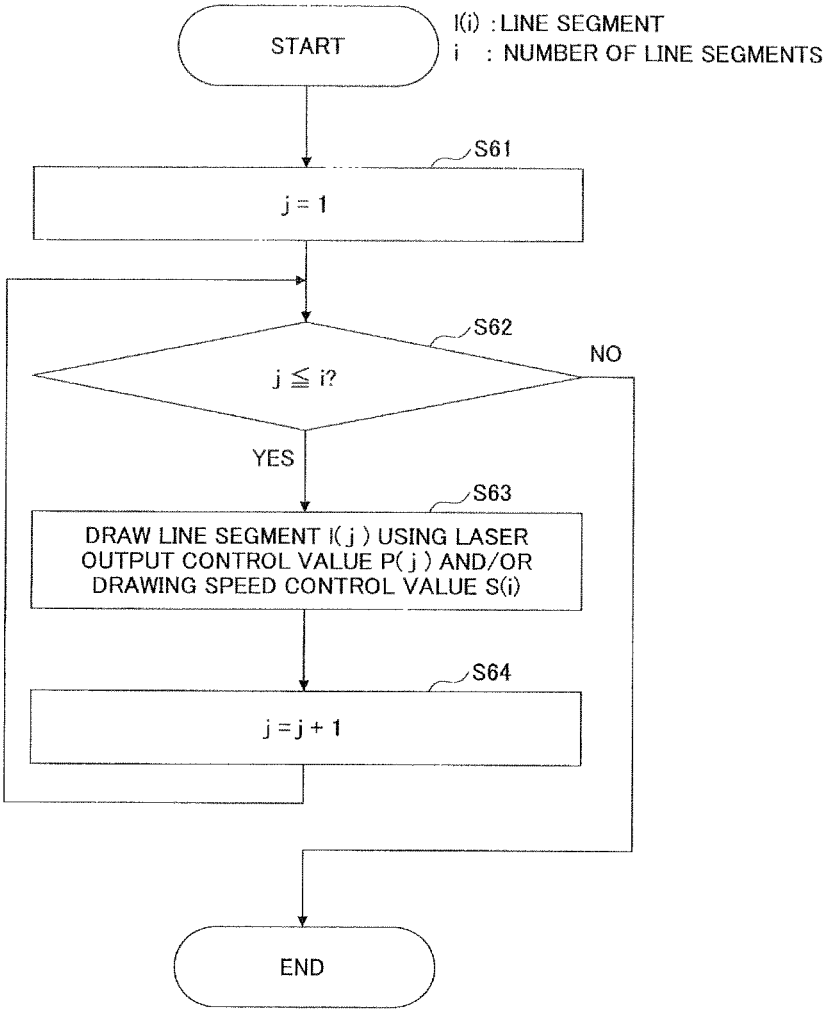
FIG. 21 is a flowchart showing exemplary detailed process steps of step S60 of FIG. 17.

FIG. 21 is a flowchart showing exemplary detailed process steps of step S60 of FIG. 17. The writing control apparatus 20 sets the initial value of a counter value j equal to "1" (j=1) (S61).

While the counter value j is less than or equal to the number of line segments i (j≤i) (S62, YES), the writing control apparatus 20 draws line segment l(j) using the drawing speed control value S(j) and/or the laser output control value P(j) (S63).

Then, the writing control apparatus 20 increments the counter value j by 1 (j=j+1) (S64).

The drawing process of FIG. 21 is ended when the counter value j exceeds i, corresponding to the number of line segments into which the stroke is divided.

[Stroke Division and Control Value Adjustment Examples]

In the following, exemplary cases of dividing a stroke and assigning control values for line segments are described. It is noted that in the following examples, the number of adjustment levels n to which a control value may be adjusted is assumed to be 3 (n=3). Also, in the following examples, it is assumed that the control values are for adjusting the drawing speed. However, these examples may be similarly applied to cases in which the control values are for adjusting the laser output or for adjusting both the drawing speed and the laser output.

Figure 22A:
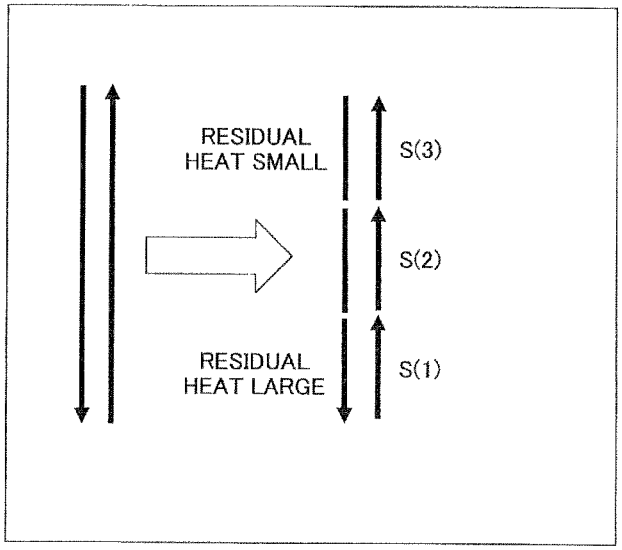
FIGS. 22A-22B illustrate exemplary ways of adjusting a control value in a case where a division number into which a stroke is divided is less than or equal to a number of adjustment levels for the control value.

FIG. 22A illustrates a case in which the division number m into which a stroke is divided is less than or equal to n. The division number m may be less than or equal to n when the length of the stroke is relatively short. Such a case is likely to occur when the number of adjustment levels n is relatively large and the stroke to be divided is relatively short. FIG. 22A illustrates a case in which both m and n equals 3 (m=3, n=3).

Since both m and n are set equal to 3 in FIG. 22A, the three line segments into which a stroke is divided are drawn using different drawing speed control values. That is, drawing speed control value S(1) is assigned to line segment l(1), drawing speed control value S(2) is assigned to line segment l(2), and drawing speed control value S(3) is assigned to line segment l(3).

Figure 1:
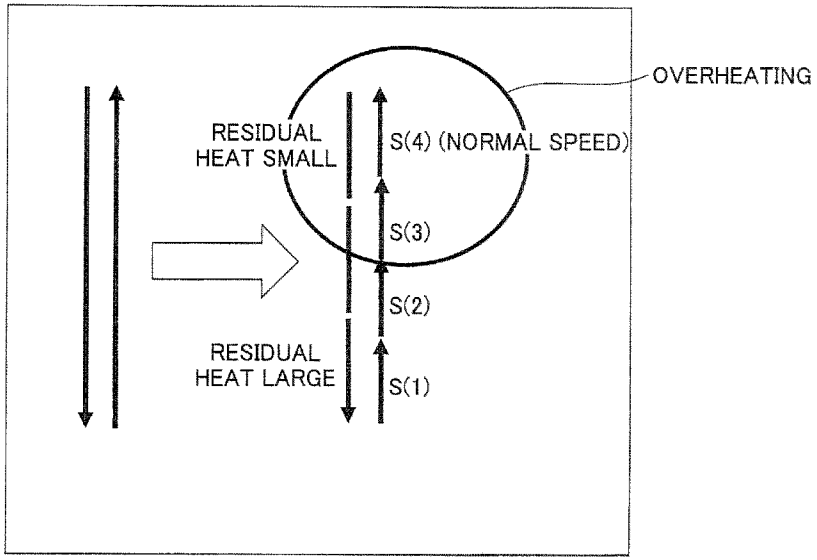
FIG. 1 is a diagram illustrating a problem that may be encountered when a stroke to be drawn is relatively short.
Figure 2:
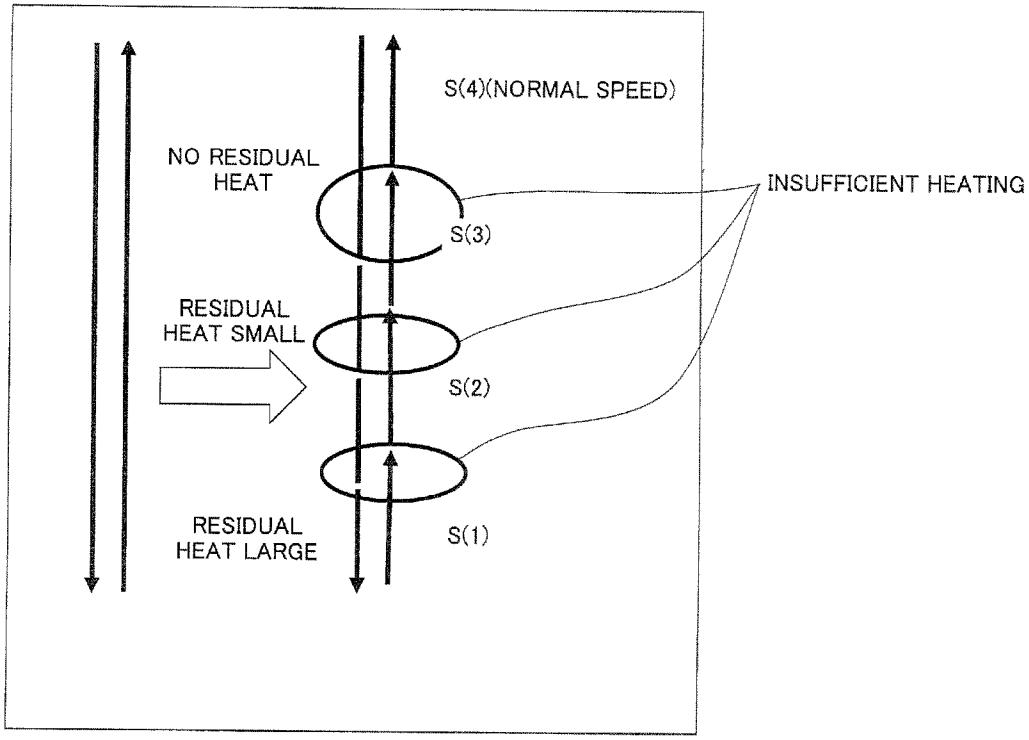
FIG. 2 is a diagram illustrating a problem that may be encountered when a stroke to be drawn is relatively long.
Figure 22B:
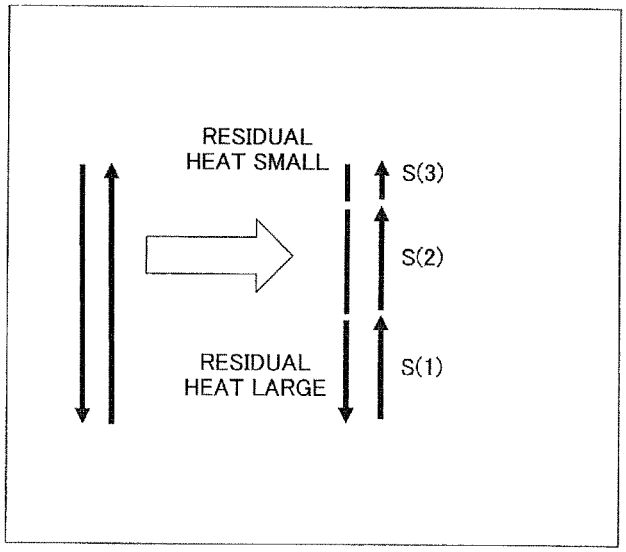

FIG. 22B illustrates a case in which the division number m is less than or equal to n and the length of the stroke is shorter than the example shown in FIG. 22A. In the present embodiment, the length of the line segment is fixed at length lu regardless of the stroke length. Thus, in FIG. 22B, the length of the line segment l(3) is less than the length lu, and an appropriate control value may be assigned to line segment l(3) based on the amount of residual heat affecting the line segment l(3). It is noted that conventionally, a stroke would be divided into line segments with equal lengths as is shown in FIG. 1. Thus, when the length of the stroke is short as in the example shown in FIG. 22B, an appropriate control value according to the impact of residual heat could not be assigned to the line segments. For example, the normal drawing speed would be assigned to draw line l(3) in which case the rewritable paper 14 may be prone to overheating.

Figure 23A:
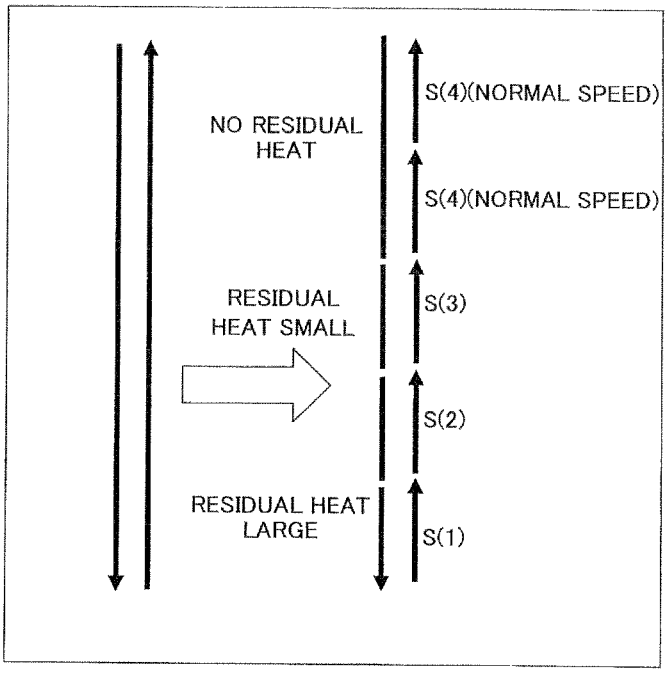
FIGS. 23A-23B illustrate exemplary ways of adjusting a control value in a case where the division number is greater than the number of adjustment levels.

FIG. 23A illustrates a case in which the division number m is greater than the number of adjustment levels n. The division number m may be greater than n when the length of the stroke is relatively long. Such a case is likely to occur when the length of the stroke is relatively long and the number of adjustment levels n is relatively small. FIG. 23A illustrates a case in which m is equal to 5 (m=5).

In FIG. 23A, control values S(1)-S(3) are assigned to line segments l(1)-l(3) in a manner similar to the example shown in FIG. 22A. Since the stroke in FIG. 23A is longer than that shown in FIG. 22A, the stroke is divided into additional line segments l(4) and l(5). In the present embodiment, the control value for the normal drawing speed is assigned to the line segments l(4) and l(5) in step S56 of FIG. 20. That is, the line segments l(4) and l(5) are arranged to be drawn using the normal drawing speed. In this way, the portion of a backward stroke that is not affected by residual heat may be drawn using the normal drawing speed (slowest drawing speed) so that the rewritable paper 14 may be heated to an adequate temperature for inducing coloration.

It is noted that FIG. 23A illustrates a case where the determination condition used in step S43 of FIG. 19 is merely based on whether the counter value is less than the division number m (i<m). That is, the stroke in FIG. 23A is divided into line segments regardless of the number of adjustment levels n.

Figure 23B:
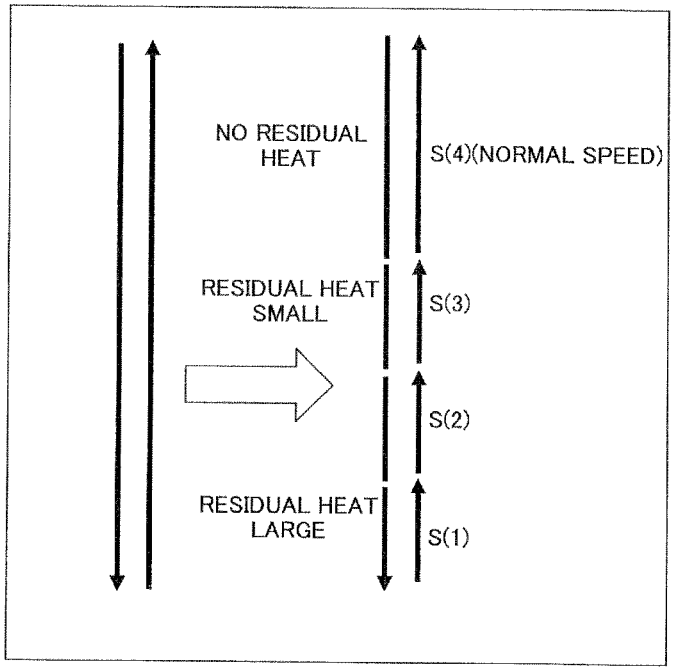

FIG. 23B illustrates a case where the length of the stroke is the same as that shown in FIG. 23A but the stroke is not divided into more than (n+1) line segments. That is, since n is equal to 3 (n=3) in the present example, the stroke of FIG. 235 is divided up to the fourth line segment l(4) but not the fifth line segment, and the length of the fourth line segment l(4) is equal to (stroke length−lu×n).

It is noted that FIG. 23B illustrates a case where the determination condition used in step S43 of FIG. 19 is based on whether the counter value i is less than the division number m (i<m) and whether the counter value i is less than or equal to the number of adjustment levels n (i≤n). That is, when the division number m is greater than the number of adjustment levels n, the stroke is not divided into more than (n+1) line segments. In this way, control value adjustment may be performed more efficiently compared to the case shown in FIG. 23A, for example.

Figure 24A:
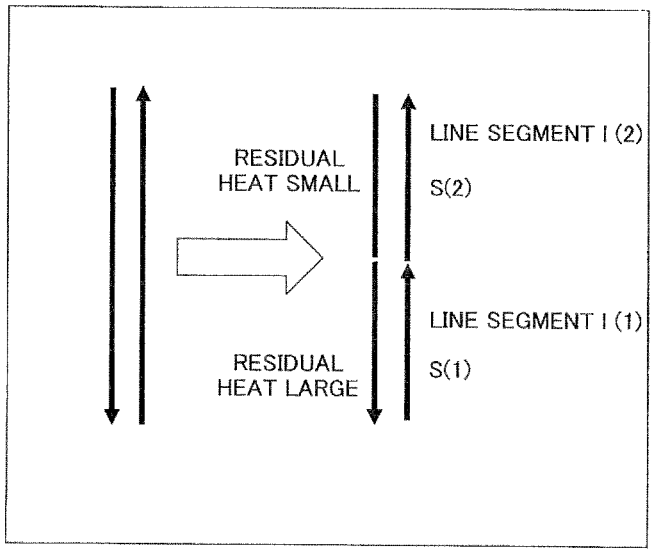
FIGS. 24A-24B illustrate exemplary ways of generating a control command according to an embodiment of the present invention.

FIG. 24A illustrates an exemplary case where the writing apparatus 20 draws a barcode with the following conditions:

Length that can be drawn before impact of residual heat disappears: 3000

Number of adjustment levels to which the drawing speed may be adjusted: 3

Drawing speed value used for each control value: S(1)=1030, S(2)=1020, S(3)=1010

Normal drawing speed: S(4)=1000

Height of barcode (stroke length): 2000

Line segment length: 3000/3=1000

Number of line segments after division: 2000/1000=2

Based on the above conditions, a stroke for drawing the barcode is divided into two line segments, which are denoted as l(1) and l(2). Thus, the drawing speed S(1)=1030 is assigned to line segment l(1) and the drawing speed S(2)=1020 is assigned to line segment l(2).

Figure 24B:
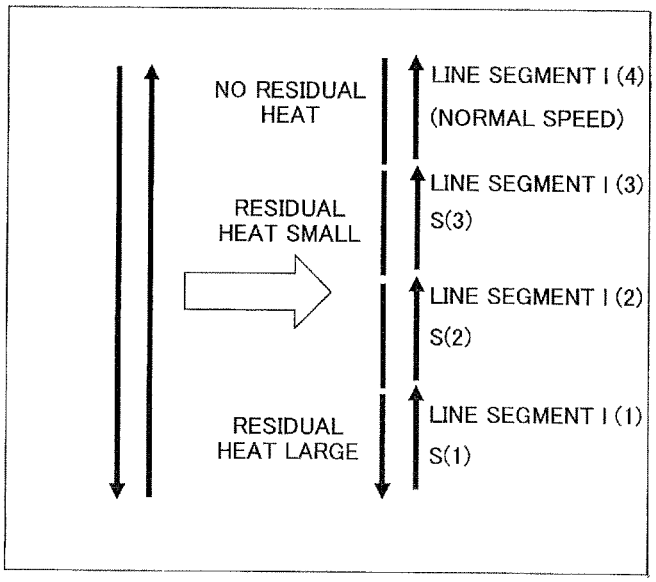

FIG. 24B illustrates an exemplary case where the writing apparatus 20 draws a barcode with the following conditions:

Length that may be drawn before impact of residual heat disappears: 3000

Number of adjustment levels to which the drawing-speed may be adjusted: 3

Drawing speed value used for each control value: S(1)=1030, S(2)=1020, S(3)=1010

Normal drawing speed: S(4)=1000

Height of barcode (stroke length): 4000

Line segment length: 3000/3=1000

Number of line segments after division: 4000/1000=4

Based on the above conditions, a stroke for drawing the barcode is divided into four line segments, which are denoted as l(1)-l(4). Thus, the drawing speed S(1)=1030 is assigned to line segment l(1), the drawing speed S(2)=1020 is assigned to line segment l(2), the drawing speed S(3)=1010 is assigned to line segment l(3), and the normal drawing speed S(4)=1000 is assigned to line segment l(4).

Figure 25A:
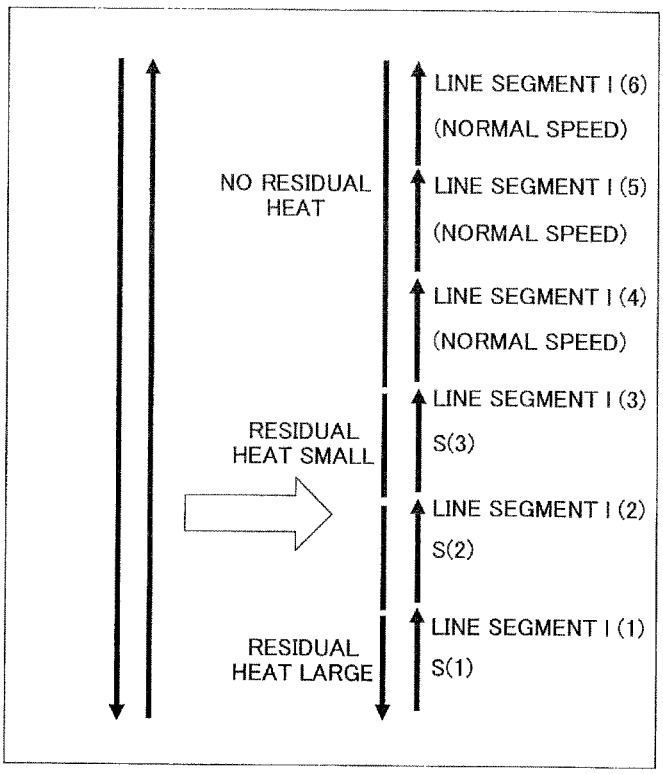
FIGS. 25A-25B illustrate other exemplary ways of generating a control command according to an embodiment of the present invention.

FIG. 25A illustrates an exemplary case where the writing control apparatus 20 draws a barcode with the following conditions:

Length that can be drawn before impact of residual heat disappears: 3000

Number of adjustment levels to which the drawing speed may be adjusted: 3

Drawing speed value used for each control value: S(1)=1030, S(2)=1020, S(3)=1010

Normal drawing speed: S(4)=1000

Height of barcode (stroke length): 6000

Line segment length: 3000/3=1000

Number of line segments after division: 6000/1000=6

Based on the above conditions, a stroke for drawing the barcode may be divided into six line segments, which are denoted as l(1)-l(6). Thus, the drawing speed S(1)=1030 is assigned to line segment l(1), the drawing speed S(2)=1020 is assigned to line segment l(2), the drawing speed S(3)=1010 is assigned to line segment l(3), and the normal drawing speed S(4)=1000 is assigned to line segments l(4)-l(6).

Figure 25B:
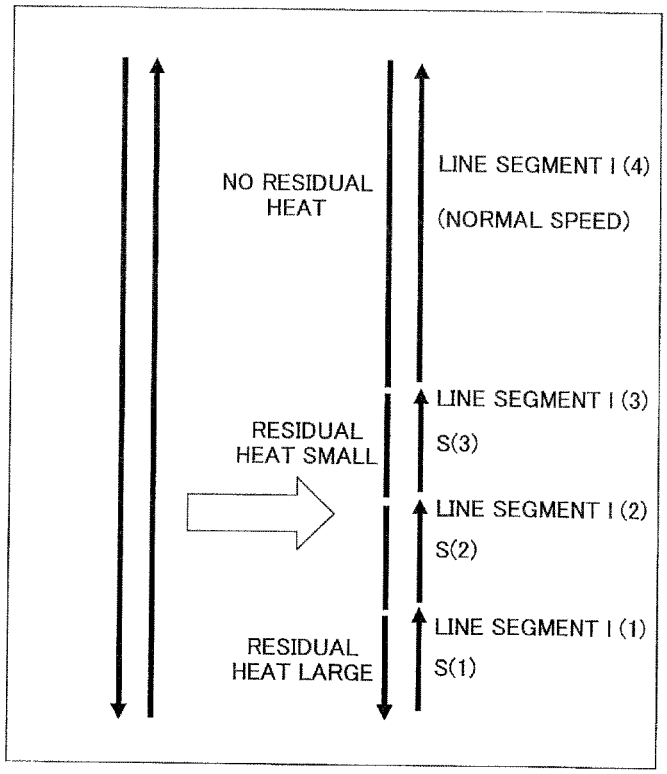

FIG. 25B illustrates an exemplary case where the stroke shown in FIG. 25A is not divided into more than 3+1 line segments. In FIG. 25B, the stroke is divided up to line segment l(4) but no further. That is the portion of the stroke corresponding to line segments l(4)-l(6) in FIG. 25A make up line segment l(4) in FIG. 25B, and the normal drawing speed S(4)=1000 is assigned to the line segment l(4).

As can be appreciated, the writing control apparatus 20 according to the present embodiment divides a stroke into line segments with a fixed length lu regardless of the length of the stroke so that the drawing speed and/or the laser output for drawing each line segment may be adjusted to an appropriate level according to the impact of residual heat. For example, even if the stroke is relatively short, the stroke is divided into line segments with the fixed length lu and an appropriate drawing speed and/or laser output is assigned to draw the upper portion of the stroke so that the rewritable paper 14 may be prevented from overheating at the upper portion. Also, even if the stroke is relatively long, the stroke is still divided into line segments with the fixed length lu and an appropriate drawing speed and/or laser output is assigned to draw the line segments so that the rewritable paper 14 may be heated to a sufficient temperature for inducing coloration.

Further, the present invention is not limited to these embodiments, and numerous variations and modifications may be made without departing from the scope of the present invention.

The present application is based on and claims the benefit of the priority dates of Japanese Patent Application Nos. 2011-258140 and 2012-197727 filed on Nov. 25, 2011 and Sep. 7, 2012, respectively, the entire contents of which are hereby incorporated by reference.

The invention claimed is:

1. An information processing apparatus that generates a drawing command for prompting a drawing apparatus to draw visual information by irradiating laser light on a recording medium, the information processing apparatus comprising:

a line information obtaining unit that obtains line information of a line including a starting point of the line;

a line segment dividing unit that obtains a drawing distance drawn over a predetermined time period that must elapse before an impact of residual heat from drawing an adjacent line can be disregarded and divides at least a portion of the line from the starting point to the drawing distance into a line segment having a predetermined length, the drawing distance being determined based on the predetermined time period and a drawing speed for drawing the line; and a control factor adjusting unit that adjusts a control value of a laser control factor that affects a density of the line segment on the recording medium, the control value being adjusted with respect to a normal control value such that the control value for the line segment that is affected by a greater amount of residual heat is adjusted to a greater extent.

2. The information processing apparatus as claimed in claim 1, wherein the line segment dividing unit determines the predetermined length of the line segment by obtaining a number of adjustment levels for the control value of the laser control factor and dividing the drawing distance by the number of adjustment levels.

3. The information processing apparatus as claimed in claim 2, wherein the line segment dividing unit divides an entire length of the line into the line segments;

the control factor adjusting unit adjusts the control value for the line segment that is located beyond the drawing distance to a normal control value; and the control factor adjusting unit adjusts the control value for the line segment that is located within the portion of the line from the starting point to the drawing distance to an adjusted control value that adjusts the density of the line segment to a reduced level compared to the normal control value.

4. The information processing apparatus as claimed in claim 2, wherein the line segment dividing unit compares a number of line segments into which the line has been divided with the number of adjustment levels for the control value, and stops dividing the line into the line segment when the number of line segments exceeds the number of adjustment levels;

the control factor adjusting unit adjusts the control value for the line segment that is located within the portion of the line from the starting point to the drawing distance to an adjusted control value that adjusts the density of the line segment to a reduced level compared to a normal control value; and the control factor adjusting unit adjusts the control value for a portion of the line beyond the drawing distance to the normal control value.

5. The information processing apparatus as claimed in claim 4, wherein when an entire length of the line is shorter than the drawing distance, the line segment dividing unit divides the entire length of the line into the line segment with the predetermined length from the starting point of the line.

6. The information processing apparatus as claimed in claim 5, wherein the line segment that includes an end point of the line has a length that is less than the predetermined length of the line segment.

7. The information processing apparatus as claimed in claim 6, wherein the laser control factor includes at least one of a laser output level and the drawing speed for drawing the line.

8. The information processing apparatus as claimed in claim 7, wherein the control factor adjusting unit adjusts the control value of at least one of the laser output level and the drawing speed for drawing the line segment such that the line segment that is located closer to the starting point is drawn at a lower laser output level and a higher drawing speed.

9. The information processing apparatus as claimed in claim 8, wherein the drawing command is for drawing a rectangular region of a barcode by scanning the lines substantially parallel and adjacent to each other on the recording medium using the laser light.

10. An information processing method used by an information processing apparatus to generate a drawing command for prompting a drawing apparatus to draw visual information by irradiating laser light on a recording medium, the information processing method comprising the steps of:

obtaining line information of a line including a starting point of the line;

obtaining a drawing distance drawn over a predetermined time period that must elapse before an impact of residual heat from drawing an adjacent line can be disregarded and dividing at least a portion of the line from the starting point to the drawing distance into a line segment having a predetermined length, the drawing distance being determined based on the predetermined time period and a drawing speed for drawing the line; and adjusting a control value of a laser control factor that affects a density of the line segment on the recording medium, the control value being adjusted with respect to a normal control value such that the control value for the line segment that is affected by a greater amount of residual heat is adjusted to a greater extent.

11. An information processing system for drawing visual information on a recording medium by irradiating laser light, the information processing system comprising:

a line information obtaining unit that obtains line information of a line including a starting point of the line;

a line segment dividing unit that obtains a drawing distance to be drawn over a predetermined time period that must elapse before an impact of residual heat from drawing an adjacent line can be disregarded and divides at least a portion of the line from the starting point to the drawing distance into a line segment having a predetermined length, the drawing distance being determined based on the predetermined time period and a drawing speed for drawing the line;

a control factor adjusting unit that adjusts a control value of a laser control factor that affects a density of the line segment on the recording medium, the control value being adjusted with respect to a normal control value such that the control value for the line segment that is affected by a greater amount of residual heat is adjusted to a greater extent; and a laser irradiating apparatus that draws the line segment by irradiating the laser light from one end to another end of the line segment using the control value adjusted for the line segment.

* * * * *